US006422315B1

(12) United States Patent
Dean

(10) Patent No.: US 6,422,315 B1
(45) Date of Patent: Jul. 23, 2002

(54) SUBSEA DRILLING OPERATIONS

(76) Inventor: Quenton Wayne Dean, 477 High Meadow, Bellville, TX (US) 77418

( * ) Notice: Subject to any disclaimer, the term of this patent is extended or adjusted under 35 U.S.C. 154(b) by 0 days.

(21) Appl. No.: 09/396,823

(22) Filed: Sep. 14, 1999

(51) Int. Cl.[7] ..... E21B 7/128; E21B 41/04; E21B 41/10; B63C 11/52

(52) U.S. Cl. ..... 166/339; 166/340; 166/341; 175/7; 405/191

(58) Field of Search ..... 166/338, 339, 166/340, 341, 354; 405/188, 190, 191; 175/7

(56) References Cited

U.S. PATENT DOCUMENTS

| | | | | | |
|---|---|---|---|---|---|
| RE24,609 | E | | 2/1959 | Johnson | 166/88.1 |
| 2,929,610 | A | | 3/1960 | Stratton | 166/354 |
| 3,830,306 | A | | 8/1974 | Brown | 166/315 |
| 3,917,006 | A | | 11/1975 | Kellner | 175/5 |
| 3,957,079 | A | * | 5/1976 | Whiteman | 137/596.18 |
| 4,007,905 | A | | 2/1977 | Mott | 251/1.1 |
| 4,452,312 | A | * | 6/1984 | Roblin | 166/339 |
| 4,478,279 | A | | 10/1984 | Puntar et al. | 166/121 |
| 4,589,493 | A | * | 5/1986 | Kelly et al. | 166/341 |
| 4,702,320 | A | * | 10/1987 | Gano et al. | 166/343 |
| 5,398,761 | A | | 3/1995 | Reynolds et al. | 166/344 |
| 5,992,526 | A | | 11/1999 | Cunningham et al. | 166/343 |

FOREIGN PATENT DOCUMENTS

| | | | | |
|---|---|---|---|---|
| GB | 2194980 | * | 3/1988 | E21B/43/01 |

OTHER PUBLICATIONS

ROV Pilot Technicians Perform Critical Role In Offshore Drilling, Houston Chronicle, Sep. 12, 1999.

* cited by examiner

*Primary Examiner*—David Bagnell
*Assistant Examiner*—Jennifer H Gay
(74) *Attorney, Agent, or Firm*—Guy McClung

(57) ABSTRACT

A method for retrieving a subsea pod from a lower marine riser package platform by connecting a buoyant pod retriever to the subsea pod and raising the subsea pod to the surface. In certain aspects, such a method is accomplished without an interruption of associated subsea drilling operations and/or without disconnecting the lower marine riser package from an associated subsea stack. Such a method, in certain aspects, includes: positioning a retrieval module above the pod container, the retrieval module having a pod holder releasably connected thereto; disconnecting the pod holder from the retrieval module; lowering the pod holder to the pod container and releasably connecting the pod holder to the pod container; releasing the pod container from the subsea lower marine riser platform; raising the pod holder to the retrieval module and releasably connecting the pod holder with the pod container to the retrieval module; and raising the retrieval module with the pod container to a location at the surface. Such pod containers are, in certain aspects, part of a multiply redundant control system.

4 Claims, 22 Drawing Sheets

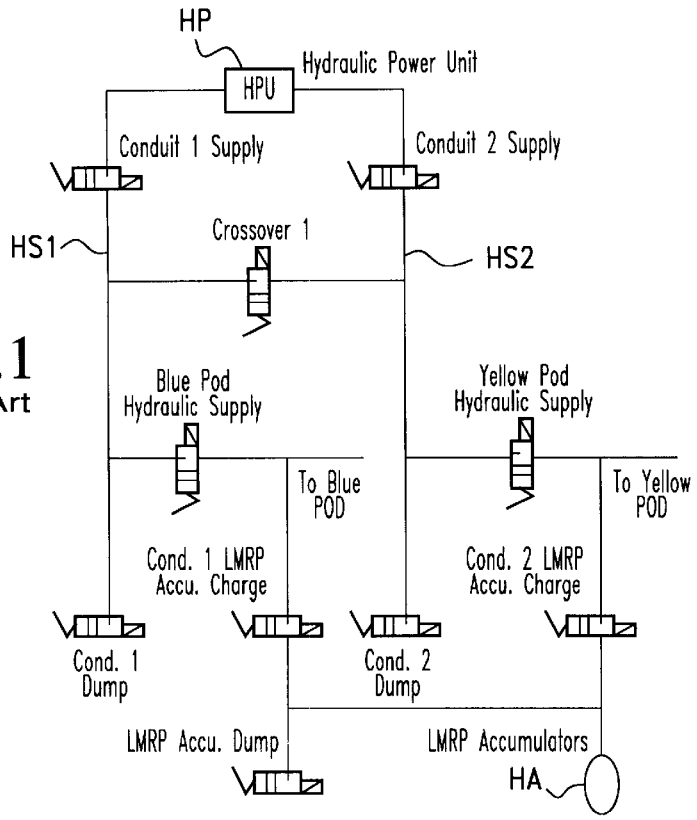
FIG.1
Prior Art
Hydraulic Supply Schematic, Dual Redundant
FIG.2
Prior Art
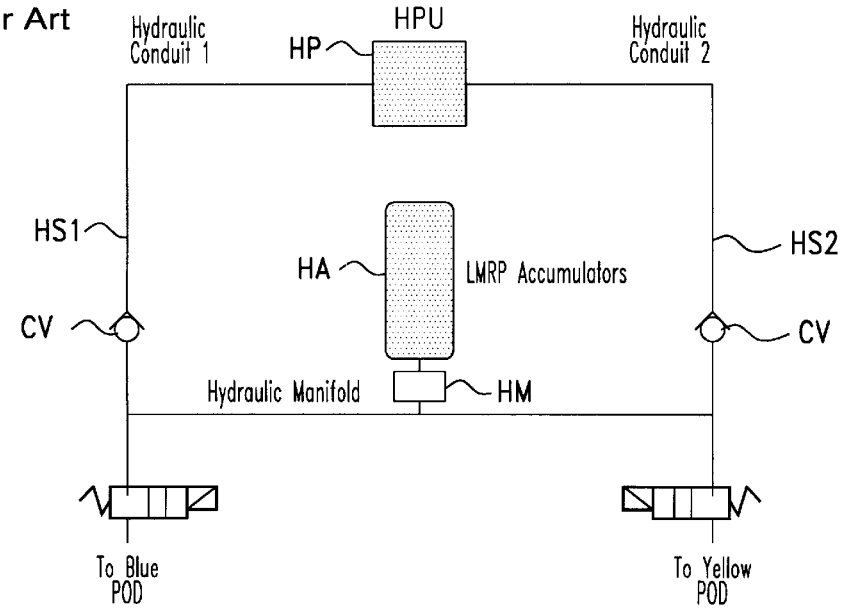

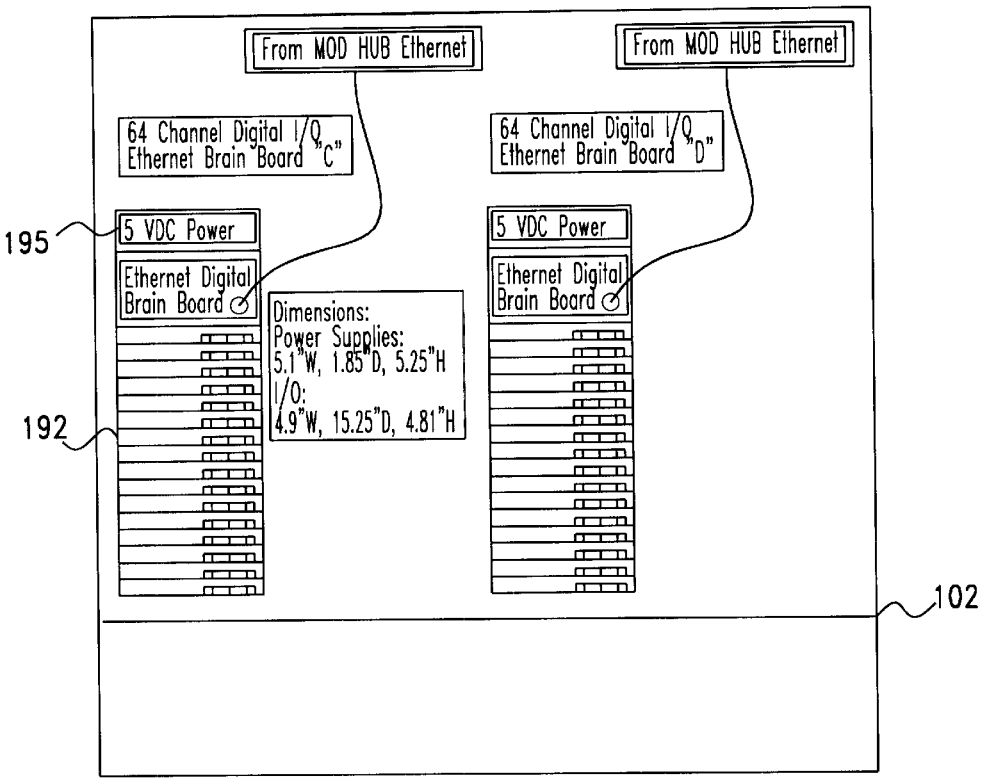
FIG.21B
FIG.21C
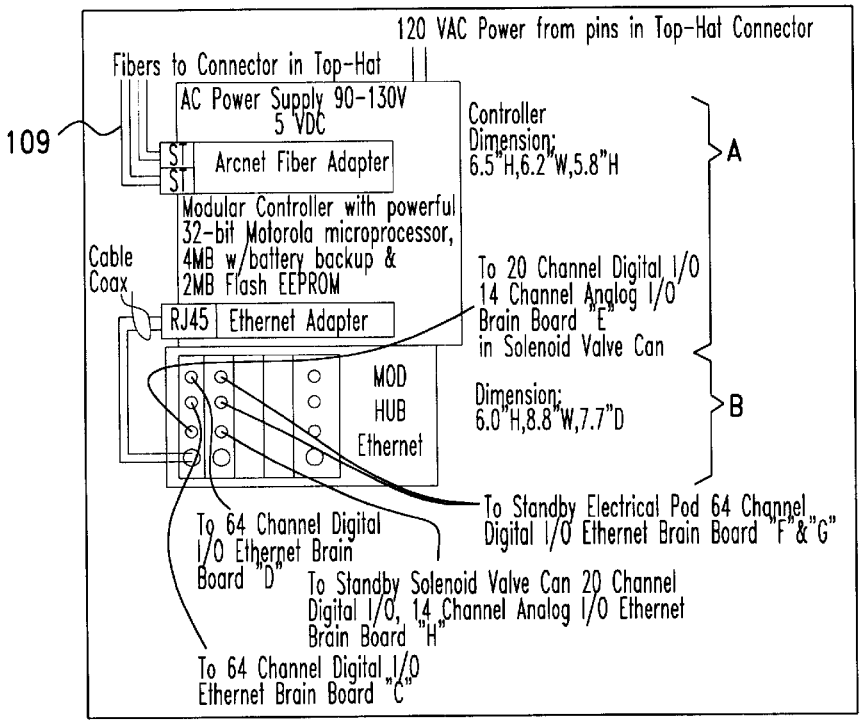

SUBSEA DRILLING OPERATIONS

BACKGROUND OF THE INVENTION

1. Field of the Invention

The present invention is directed to subsea drilling operations and, in certain particular embodiments, to retrieval systems and operations for retrieving pod containers from a subsea lower marine riser package platform.

2. Description of Related Art

In subsea drilling operations as shown in FIGS. 3 and 4, one or more subsea pod containers BP, YP are located on a lower marine riser package ("LMRP") LM platform encompassing a riser RS through which drilling operations are conducted. These "pods" contain electronics and valves that are used in the monitoring and control of a wide variety of functions related to drilling operations. Typically the pods are releasably connected to an LMRP which is the top portion of a structure or "stack" ST that includes blowout preventers ("BOP") and related apparatus used for well control.

The prior art discloses redundant systems which employ two similar pods so that if there is a failure in one "on line" pod, e.g. a failure of electronics or of a valve, the other "standby" pod can be brought to an "on line" status, e.g. by a Driller, to immediately perform the required actions or functions. The retrieval of a pod for replacement or for repair is a complex and expensive operation. To retrieve an LMRP with a failed pod requires removal of the riser to which the LMRP is connected. The riser extends from the drill floor, e.g. from a boat or rig at the water's surface, down to the stack. "Tripping" out the riser is a long expensive process, and LMRP retrieval requires such a "trip."

Many prior art deep water multiplexed BOP Control Systems include two identical systems either of which may control Stack functions. One such system is illustrated schematically in FIG. 1. This configuration is commonly referred to as being "Dually Redundant". Both systems may be active electronically and may have single or dually redundant sets of electronic controls. One of the systems including one of the pods is active hydraulically. The system that is active hydraulically is manually selected by a Driller to be the active system or "Active Pod". Each system, or Pod, is equipped with an hydraulic conduit supply. This supply is run from an Hydraulic Pressure Unit (HPU) HP on the surface to the Pod that is mounted on the LMRP. A "Crossover Valve" may be actuated. This actuation diverts hydraulic fluid from the Pod it is designed to supply to the redundant Pod normally supplied by the other conduit. This "Crossover" function allows either Pod to be supplied by either conduit. This is a Driller actuated, manual function and pod redundancy is lost during retrieval.

Also mounted on the LMRP are Hydraulic Accumulators HA. These Accumulators supply hydraulic fluid for the Stack functions at a consistent pressure so that a function is actuated according to the manufacturer's specifications. Each Pod's Hydraulic supply conduit HS1, HS2, resepctively, is connected to the Hydraulic Accumulator's Hydraulic Manifold HM so, that the conduit which has been selected as the active Hydraulic supply line may "charge" the Hydraulic Accumulators. Check valves CV prohibit the hydraulic fluid from backing-up the un-used, or not active, Hydraulic supply conduit. Thus, whichever conduit is selected as the active hydraulic supply will "charge" the LMRP mounted Accumulators. API requirements as well as normal "Oil-Field tradition" classify one of the hydraulic supply conduits as the Blue supply. The other hydraulic supply conduit is classified as the Yellow supply. The Pod traditionally associated with the Blue supply is classified as the Blue Electro/Hydraulic (E/H) Pod, or Blue Pod. Conversely, the other Pod is traditionally classified as the Yellow Pod (e.g. as shown in FIG. 2). The prior art system of FIGS. 1, 2 functions as do the same parts that are in the system of FIG. 19, but without the triple redundancy of the system of FIG. 19.

A typical prior art Blowout Preventer (BOP) Control System regulates a well during drilling operations and continuously monitors the status of such operations. The BOP system includes a structure that incorporates hydraulically actuated well control safety devices and their peripheral components, i.e. blowout preventer system. Such apparatus is referred to as the Blow Out Preventer Stack or simply as the "Stack". The upper portion of the "Stack" is referred to as the Lower Marine Riser Package (LMRP). The LMRP includes a platform and is the interface between the Riser system and the "Stack". It is a separate structure and is supplied with, or as a part of, the "Stack". The LMRP is connected to the "Stack" via a hydraulically actuated "Stack" connector. It is connected to the Riser by a "RISER" connector. Between these two connections there may be inserted "BAG" BOP's "Pipe" BOP's (Pipe Rams), and/or other instrumentation or controlled protective and supplementary equipment. This LMRP "platform" also physically supports hydraulic accumulators and the BOP Control System Subsea Electro-Hydraulic (E/H) "PODS". These subsea "E/H Pods" perform the well control regulation tasks as supervised by the Driller from the Drill Floor of the Rig. The Driller may regulate a parameter, i.e. a hydraulic pressure subsea on the LMRP or "STACK", or control a function, i.e. close a pipe ram BOP, and/or monitor the real time actuation of the function controlled or the parameter regulated.

Many of the BOP Control System's end functions are on the lower portion of the "STACK", i.e. below the LMRP "STACK" Connector. A command from the Driller is transmitted serially via fiber optics or cable, onto a "data freeway". The electronic I/O equipment located in the Subsea E/H Pod retrieves data and instructions from, and writes status to, the data freeway. These instructions (commands) are performed with electronic I/O equipment that interfaces with electro/hydraulic functions, i.e. electrical solenoid valves. These solenoid valves either hydraulically actuate LMRP functions directly, or pilot larger valves i.e., sub plate mounted (SPM) valves. These SPM valves supply hydraulic fluid at greater volummes or flow rates than could be accomplished with the solenoid valves themselves.

These SPM valves supply hydraulic fluid to hydraulic connectors, or stab plates, which allow LMRP accumulator hydraulic fluid flow to the "Stack" mounted functions below. The LMRP Accumulators are supplied via multiple sources from the surface Hydraulic Pressure Unit (HPU). The LMRP Accumulators are "float" charged by the Driller selected surface hydraulic source, i.e. one of the multiple sources. This fluid, in route to a Stack mounted function, migrates through the solenoid valve, to the SPM valve piloted actuator, through the SPM valve supply ports, through the hydraulic connector, through a series of shuttle and check valves, and then on to actuate the desired Stack mounted, piston-like, function. These Stack mounted functions are referred to as a "Stack function". The series of shuttle and check valves encountered by the hydraulic flow is necessary to enable redundancy of control. There is an E/H Pod associated with each of the surface hydraulic supplies.

As stated above for redundancy, "Oil Field" tradition dictates that one hydraulic source be associated with one E/H Pod. This Pod will be designated as the "Blue Pod". Another hydraulic source will be associated with another E/H Pod and this combination should be labeled the "Yellow Pod". Each one of these pods are identical, and contain identical components, i.e. the electronic I/O, the solenoid valves, the SPM valves, and the hydraulic stab plate (LMRP side). Each hydraulic stab plate, "Stack-side", is connected by hydraulic tubing to the shuttle/check valve tubing and so terminated at the end function (Not Redundant). Only one pod is hydraulically active at a time. The other pod is considered a hot back up and may be electrically active and functioning. The electronic I/O (Input/Output) and the solenoid valves portion of the E/H Pod are referred to as the Subsea Remote Terminal Unit (SSRTU). In one integrated prior art system, the Driller is supplied with two panels. These panels mimic a portion of the BOP Control System. One panel will mimic the Blue E/H Pod. The other panel mimics the Yellow E/H Pod. Primary control of the BOP system is provided through panel mounted Push Buttons. Panel display of the system status is via lighted Push Buttons and/or pilot lights. Analog values are displayed via Analog/Digital meters. The operation of any SSRTU function begins animation with the depression of an associated Push Button. For critical functions, the Push Button must be depressed while simultaneously depressing the "push and hold-ARM" Push Button. These Push Button depressions must be conducted on the panel, Blue or Yellow., depending on which panel is hydraulically active. It is a Driller function to select one of the hydraulic subsea sources as active, i.e. either the Blue Hydraulic line or the Yellow hydraulic line. Logically, the Push Button Depression is conducted on the Pod whose hydraulic line is active, i.e. the one charging the LMRP accumulators. Identical control activity can also be performed in like manner from the Blue or Yellow Toolpusher's Panel. Two Personal Computers each with an MMI ("man-machine") interface may be provided, one in the Driller's House and the other in the Toolpusher's office. It is possible with some prior art systems to use the MMI's instead of the panels for primary control of the SSRTU's.

In one such prior art system in which the Driller has two panels and the Toolpusher has two panels (total of four panels), command data may be sent from any panel or from dual MMI interfaces to a surface mounted Programmable Logic Controller (PLC), usually in a dually redundant mode. The surface PLC may also be referred to as a central control unit or central computer unit (CCU). The CCU processes commands through audible or optical modems and transmits them to the SSRTU's. These SSRTU's are either PLC devices or microprocessor printed circuit boards and each SSRTU may be referred to as a controller. Each controller has associated electrical I/O units. These controllers are enclosed in pod containers (also referred to as electronic pods). The SSRTU's mounted on the LMRP, one of which is the on-line unit, executes the command received from the modems. "Inferred" position sensors, pressure "feed backs," transmit a signal indicating a command has been executed back to the CCU and the originating panel, or MMI via modem transmissions. Activation of a pilot light or a flow meter readback confirms the execution of the commanded function at all panels and at the MMI's. CCU functions are performed sequentially via serial data links to the remote I/O either in the panels or in the SSRTU's. If a function is not accomplished, the Driller is alerted to this and can change the system configuration to put an alternate pod on-line. If, e.g. the Driller is working on the Blue Pod fed from the Blue hydraulic conduit, he first changes to the Yellow hydraulic conduit and again tries to accomplish the previously-commanded function. If this does not work the Driller transfers control to the Yellow pod operating off of the Yellow hydraulic conduit. If the commanded function still is not accomplished, the Driller reconfigures the system with the Yellow pod using the Blue hydraulic conduit. If the command is not accomplished, typically the entire LMRP is tripped out to discover and correct the problem.

There has long been a need, recognized by the present inventor, for a safe, relatively inexpensive, and simple pod retrieval system and method. There has long been a need for such a system and method which does not require tripping of the riser to effect removal of a pod. There has long been a need for such a system and method with which drilling need not be terminated while accomplishing pod retrieval. There has long been a need for a multiply redundant stack control system.

SUMMARY OF THE PRESENT INVENTION

The present invention, in certain aspects, provides a method and a system for the efficient and effective retrieval of a pod container from a lower marine riser package platform on a subsea stack without removal of the platform from the stack, without tripping the riser, and while drilling operations continue without interruption. Preferably with such methods and systems no unwanted forces, e.g. but not limited to lateral forces, are applied to the riser or to other items.

In certain embodiments of the present invention, a remotely-operated retrieval module is moved to a position above a subsea pod to be retrieved. One or more lines are connected between the retrieval module and the platform for stability during the operation. In one aspect, the line is connected by a remotely operated vehicle. A pod holder is then released from the retrieval module to descend down around the pod. The pod holder is secured to the pod; the pod is released from the platform; and then the pod holder rises (e.g., ballasted by air) to re-unite with the retrieval module. Following disconnection of the line or lines securing the retrieval module to the platform, the retrieval module is raised to the surface and the pod is removed therefrom. A pod may be releasably secured to a lower marine riser platform with any suitable known device or mechanism, including but not limited to, those disclosed in U.S. Pat. No. 5,398,761 and the prior art cited therein, all of which is incorporated fully herein for all purposes.

In one particular system according to the present invention, a lower marine riser package platform with three pod containers provides a multiply redundant system in which any one of the three pods can perform required functions. Of course it is within the scope of this invention to use four, five or more pod containers to achieve multiple redundance.

The present invention, in certain embodiments, uses components as in various prior art systems. In one embodiment no CCU is used. Due to the critical nature of these control systems, additional components may be included in certain embodiments according to the present invention to provide a series of "stand alone" system which insures a more reliable, therefore safer, and more economic, BOP control system thus lowering drilling costs.

Certain preferred embodiments according to the present invention do not use the prior art sequential logic prevalent in industrial PLC'S (no CCU) and do not rely upon a personal computer (PC) networking of distributed I/O which is also a feature of many prior art systems. In certain embodiments according to the present invention, two communication protocols are utilized, ARCNET (trademark) communication system and ETHERNET (trademark) communication system, to arrange a network of computers, controllers, and field mounted devices into a fieldbus (as is commonly used in the industrial automation industry). This fieldbus delivers messages in a time predictable fashion. ARCNET (trademark) communication system provides for the successful transmission and reception of a data packet between two network nodes. A node refers to an ARCNET (trademark) communication system controller chip and a cable transceiver connected to the network. Nodes are assigned addresses and one ARCNET (trademark) communication system network can, in certain aspects, have up to 255 uniquely assigned nodes. To each ARCNET (trademark) communication system node in the proposed system a 32 bit microprocessor controller with up to 4 MB of battery-backed memory and 2 MB of Flash EEPRom is incorporated. Each of these nodes is referred to as a "controller."

In one aspect a BOP Control System according to the present invention has a Blue and Yellow Driller's Panel and a Blue and Yellow Toolpusher's Panel. In the present invention, there is a Blue controller and a Yellow controller for the Driller's Panel and Blue Controller and a Yellow controller for the Toolpusher's Panel. The network communicates with each node (controller) through a multi-drop Ethernet Hub. On the surface there are dual ETHERNET (trademark) communication system Hubs for reliability's sake. In certain aspects there are two PC's and each PC is configured as an ARCNET (trademark) communication system Node (or controller) equipped with MMI (Man Machine Interface) capability. These PC nodes are also multi-dropped from each of the two ETHERNET (trademark) communication system Hubs. Each of these MMI's may operate as a "soft" Driller' Panel or a "soft" Toolpusher's Panel. ("Soft" means software controlled rather than hardware controlled.) The PC's have the ability to upload each controller's memory for data—logging, trending and reduction and can also be used to download executable programs into the controllers if one's program becomes corrupt.

With ARCNET (trademark) communication system's "token passing" protocol, communication between nodes takes place in ascending order, i.e. first node (lowest address) to second node (next highest address) and so on. The network automatically reconfigures itself if another node is added or if a node fails to respond (based upon number of failures/unit of time). Should a node fail to respond, the node is bypassed (and alarmed) to the next node. Therefore, there is no "hang-up" in the network.

Communication from the controller to the I/O is the subhierarchy. Each controller is also equipped with an ETHERNET (trademark) communication system chip which allows the controller to interface with an ETHERNET (trademark) communication system hub which polls each SMART I/O) (Brain Boards) in the same multi-drop fashion that occurs on the ARCNET (trademark) communication system side of the digital network. Each brain board communicates with its associated I/O and supplies discrete change anti-coincident circuitry, means, maximums, minimums, standard deviations, sums, and flags upon exceeding upper or lower limits. The brain board also toggles, latches, unlatches, or times the digital discrete status as so directed by its controller.

Once a program (or strategy) has been downloaded into a pod's controller's memory and the controller and its associated I/O have been "powered-up," the controller runs its program continuously. It is totally independent of any other controller and it is also independent of the network even though it is a component part of the network. Any of the controllers on the surface, i.e. the Driller's MMI, his Blue Panel, his Yellow Panel, the Toolpusher's MMI, his Blue Panel, or his Yellow Panel, can issue a command to any one of the SSRTU's. In one aspect the additional SSRTU is used and is identified as the "Purple" SSRTU. In such a system there are a Blue SSRTU, a Yellow SSRTU, and a Purple SSRTU. Each SSRTU (Controller) is interfaced to each surface ARCNET (trademark) communication system Hub through fiber optic cable. For expediency's sake, the surface ARCNET (trademark) communication system nodes may probably interface to the hubs via fiber optic cable. All ETHERNET (trademark) communication system connections to the ETHERNET (trademark) communication system Hubs may be via coax cable or twisted shielded pairs of conductors. Each controller has dual communication lines, one from each ARCNET (trademark) communication system Hub.

In certain embodiments with three SSRTU's, there are three hydraulic conduit lines (see e.g. FIG. 19). In one aspect the valves are arranged so that each of the SSRTU's may be supplied from any of the three hydraulic supply lines.

The three SSRTU's may be configured by the Driller in one of the three ways listed below (see e.g. FIGS. 18 and 20):

1. Blue SSRTU as Master Yellow SSRTU as Standby Purple SSRTU as Marshal
2. Yellow SSRTU as Master Purple SSRTU as Standby Blue SSRTU as Marshal
3. Purple SSRTU as Master Blue SSRTU as Standby Yellow SSRTU as Marshal The Master unit (or pod) or the Standby unit can pilot a function (e.g. operate an SPM valve) by energizing either a coil of a dual coil solenoid valve in the Master Unit Solenoid Valve can. This energizing of a coil by the Master or Standby electronics is referred to as being "fired by" either the Master or Standby electronics in the Master Electronics pod container. It should also be noted that the Master unit in FIG. 18 supplied by conduit A is fired by Power Transformer A. The coil energized by the Standby Unit is fired by Power Transformer B. One catastrophic failure would be a failure of a controller or a Power Transformer. The failure of a controller would essentially be the same as a failure of communications to the controller. With such a failure, the Driller reconfigures the system so that the failed unit (controller or Power Transformer) is assigned to the Marshal Unit and then insure that the Marshal Unit is placed out of service. This would leave the BOP Control System with two good pods with each pod being dually redundant as well as the two pods offering dual redundancy. In this configuration, drilling would continue uninterrupted. The failed pod is retrieved as disclosed herein for repair, and the repaired pod is re-deployed to the LMRP, preferably without putting any lateral force on the Riser, the LMRP, or the Stack and without interrupting drilling operations.

It is, therefore, an object of at least certain preferred embodiments of the present invention to provide:

New, useful, unique, efficient, nonobvious systems and methods for the retrieval of pod containers used in subsea drilling operations;

Such a system and method which do not require the separation of a lower marine riser platform from a subsea stack or the tripping of a riser to retrieve a pod container;

Such methods and systems which permit pod retrieval without the interruption of drilling operations; and Such a system with three or more pod containers, each pod container with dually redundant electronics, providing multiple redundancy of function.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one skilled in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

FIGS. 1 and 2 show schematically the hydraulic supply and hydraulic circuits for a prior art two pod system.

FIG. 21B shows schematically certain master electronics for the pod of FIG. 21A. FIG. 21C shows various connections for the pod of FIG. 21A.

DESCRIPTION OF EMBODIMENTS PREFERRED AT THE TIME OF FILING FOR THIS PATENT

Figure 3:
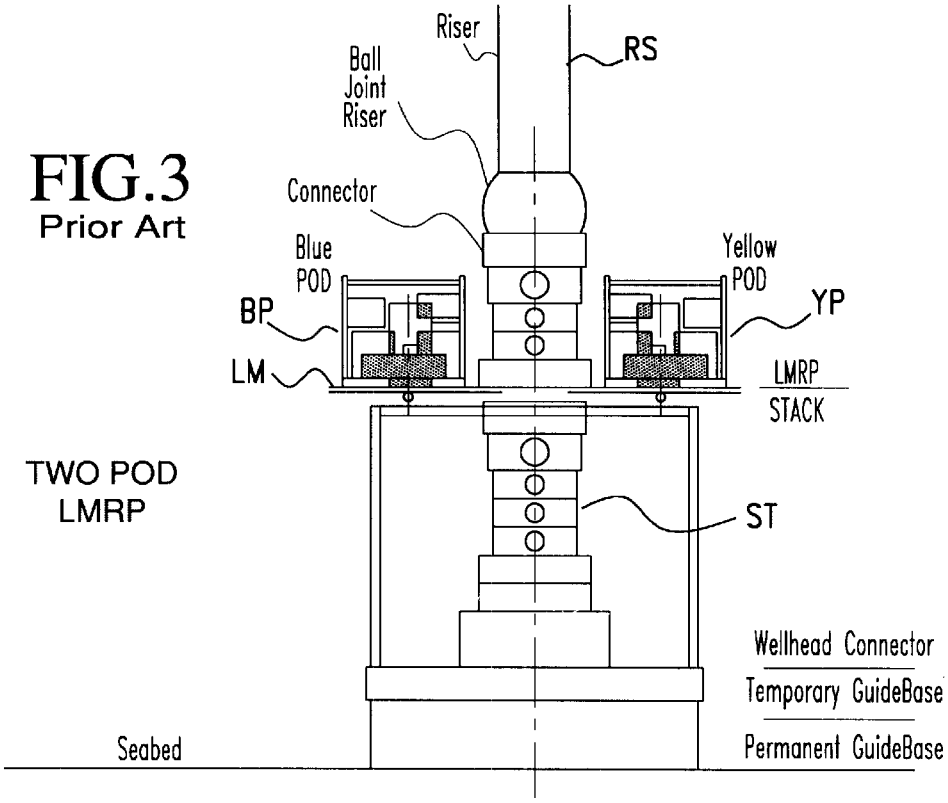
FIG.3 Prior Art
FIG. 3 shows schematically a two pod prior art system.
Figure 4:
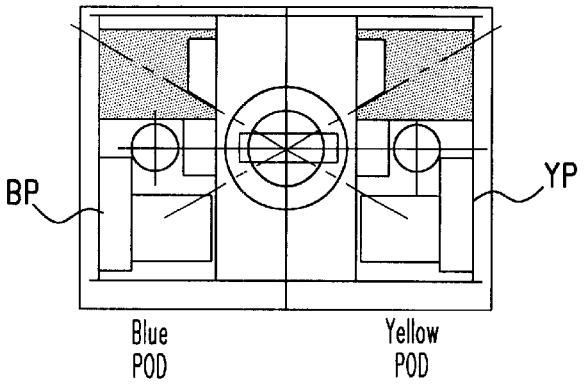
FIG.4 Prior Art
FIG. 4 is a top view of the system of FIG. 3.
Figure 5:
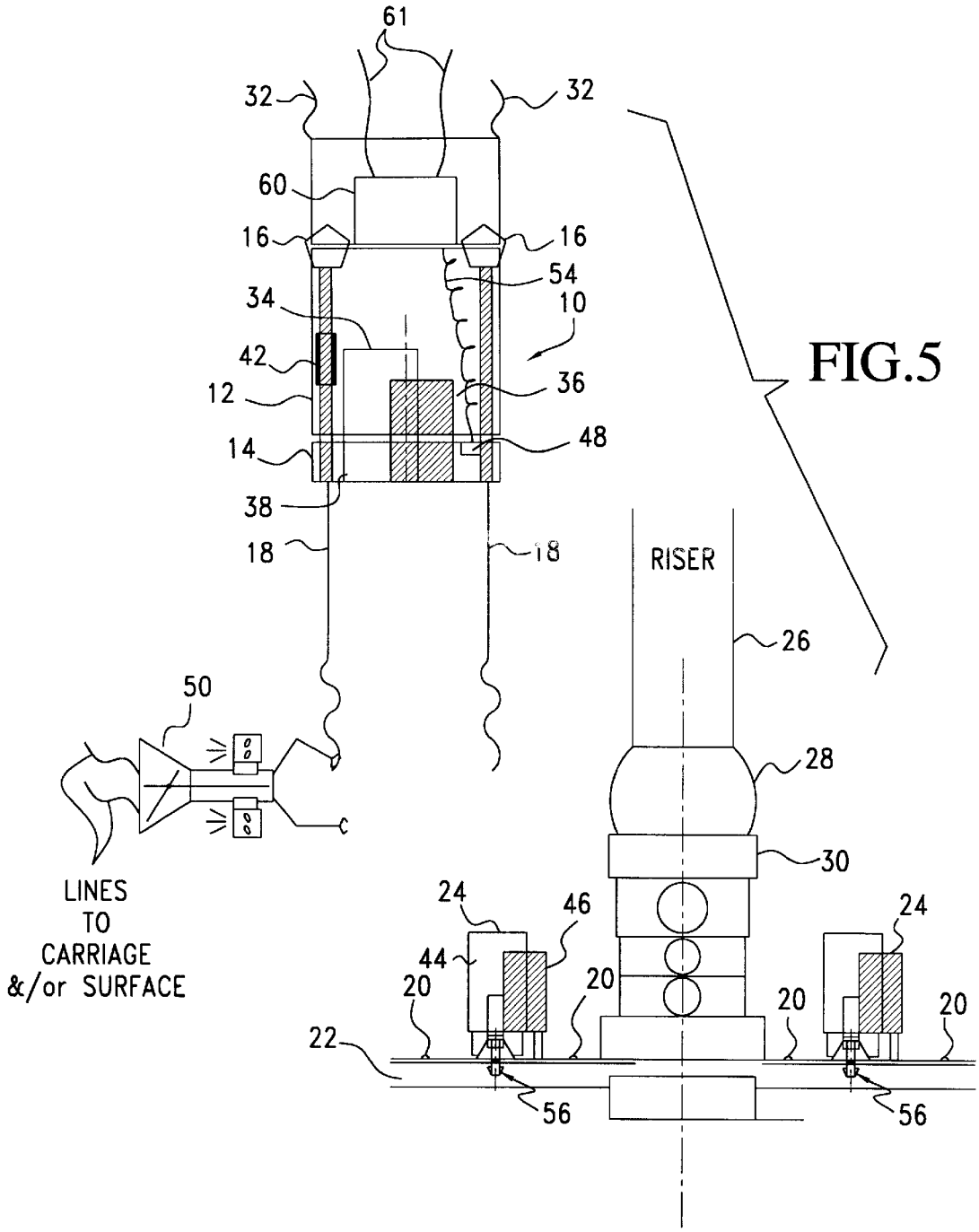
FIG. 5 illustrates schematically a pod retrieval system according to the present invention.

FIG. 5 shows a system 10 according to the present invention for retrieving a pod container from a lower marine riser package platform. It is within the scope of this invention to use such a system to retrieve any subsea apparatus releasably connected to some other item in a subsea environment.

The system 10 includes a retrieval module 12 with a pod holder 14 releasably connected thereto. Any suitable releasable connection for the pod holders may be used, e.g. but not limited to nuts and bolts, Velcro™ material, and/or mechanical ROV operable latching mechanisms (MRL). The pod holder 14 may also be referred to as a pod picker upper or PPU. Winches 16 on the retrieval module 12 spoolably hold guidelines 18 for releasably securing the retrieval module 12 to guideline pad eyes 20 on an upper surface of a lower marine riser package platform 22. Although the platform 22 is shown with two pods 24, it may have, within the scope of this invention, one, three, four or more pods. The platform 22 is part of a typical stack (e.g. like the stack in FIG. 16A) below a riser 26 with a ball joint 28 and riser connector 30 but above the stack. Lines 32 connect the module 12 to a surface boat, barge or rig (not shown).

Recesses 34, 36 in the module 12 and recesses 38, 40 in the pod holder 14 are configured and sized for receiving a pod 24 therein. Guideline sleeves 42 may be used within the module 12 and (although not shown) in the pod holder 14 (guideline sleeves made, e.g., of metal, plastic, stainless steel, PTFE; the module 12 made, e.g., of metals e.g. titanium, and the pod holder 14 made, e.g., of metal, e.g. titanium. A remotely operated vehicle 50 is used to manipulate the lines 18 and perform other functions.

As shown in FIG. 5 the pods 24, according to the present invention, include a "valve" can 44 and an "electronics" can 46. Electronics in the can 46: effect communication between the Driller's and/or Toolpusher's panels and a particular end function, e.g. closing shear rams, closing annular rams, closing an outer kill line or inner choke line (see FIG. 16D), or any other stack function; read digital inputs and provide digital outputs, e.g. to energize a solenoid valve to operate a stack function; and read analog data back from the subsea floor to the surface, e.g. temperature and pressure readings. The valve can 44 contains, inter alia, solenoid valves for piloting LMRP SPM valves or for directing LMRP functions and the electronics can 46 contains, inter alia, communication modules and solenoid drivers. The various recesses in the module 12 and pod holder 14 correspond to the shape of these cans. The cans may be separate containers or everything may be positioned in a single can. It is within the scope of this invention to retrieve a pod in which the valves, etc. are not located separate and apart from the electronics (as is the case with the pods 24).

Figure 15:
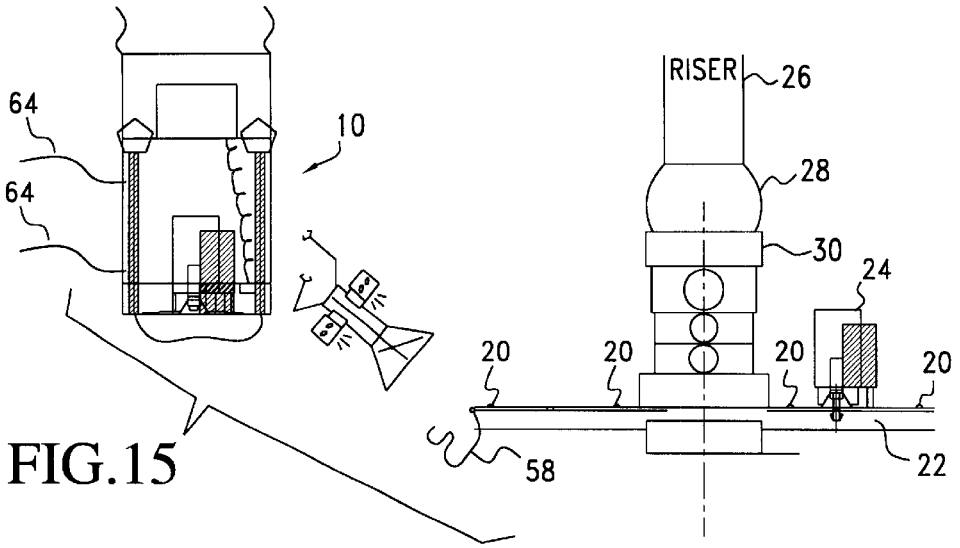

A selective ballast mechanism 48 in the pod holder 14 is interconnected with a module ballast device 60 in the module 12 via appropriate lines 54. The module ballast device 60 is controlled from the surface via an electrical umbilicals 61 (in one aspect, two such lines for redundancy) which connects to the various items and to the ballast control device or mechanism 48. The remotely operated vehicle 50 has both electrical and hydraulic umbilicals and wire rope to the surface and/or to an ROV carriage (not shown) as is well known in the art. The lines 32 also include electrical power line(s), hydraulic line(s), other utilities, such as, e.g. compressor air lines and a tag line or lines to limit horizontal movement (e.g. as line 64, FIG. 15). In certain aspects it is preferred to use known prior art "flying leads" to connect various lines to the pod holder 14, and to the pods 24, e.g. for electrical umbilical and/or hydraulics.

A releasable latch mechanism 56 releasably secures each pod 24 to the platform 22.

Figure 6:
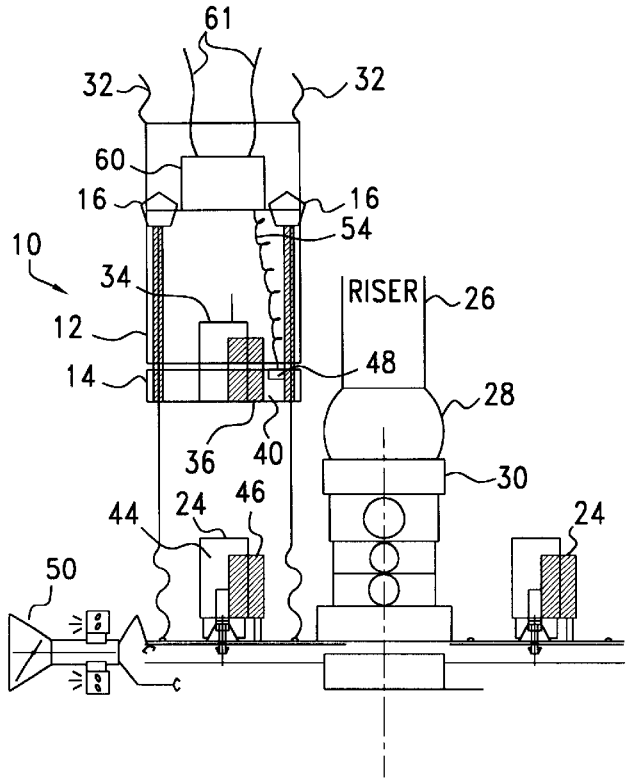
FIGS. 6–15 illustrate schematically steps in the operation of a system as in FIG. 5.
Figure 7:
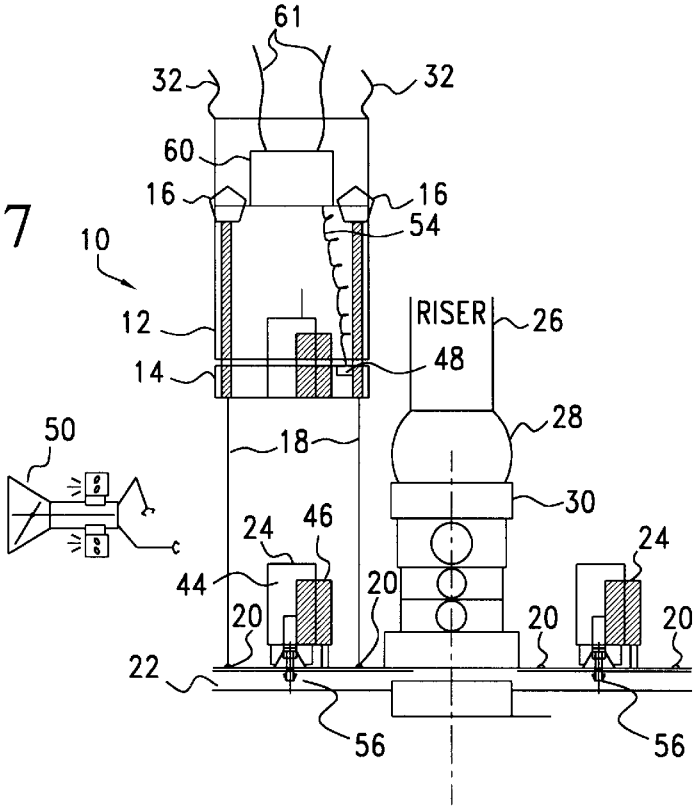

FIGS. 6–15 show various steps in a pod retrieval operation according to the present invention using a system like the system 10. As shown in FIG. 6, the system 10 has been lowered to the level of the LMRP platform 22 above one of the pods 24. The flying leads are removed by the ROV and securely stored to a connector parking plate 27 (see FIG. 16C) on the LMRP. The ROV then connects the lines 18 to the eyes 20. As shown in FIG. 7, the lines 18 have been tightened, e.g. by moving the system 10 upwardly using the winches 16. The ballast system 48 (shown schematically) may also be used to tighten lines 18.

Figure 8:
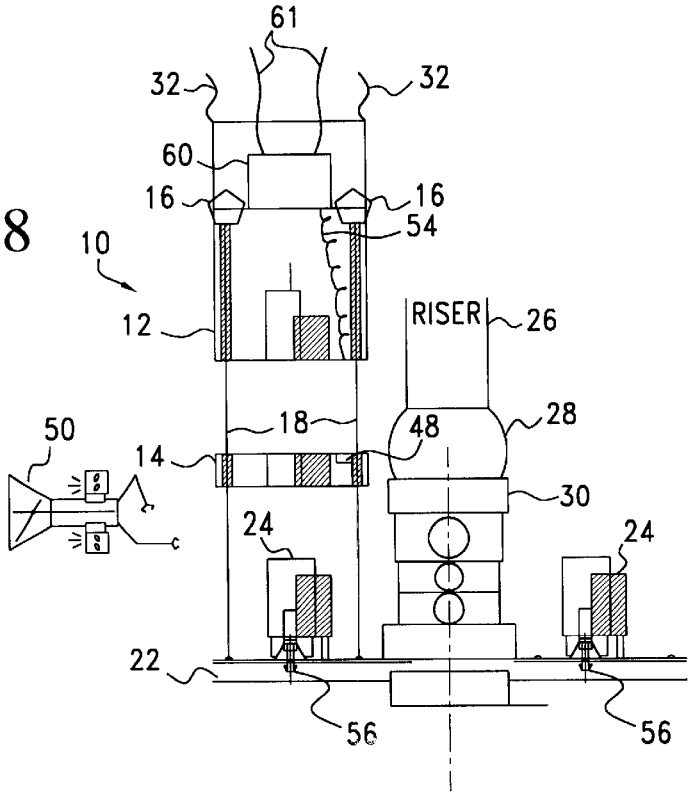
Figure 9:
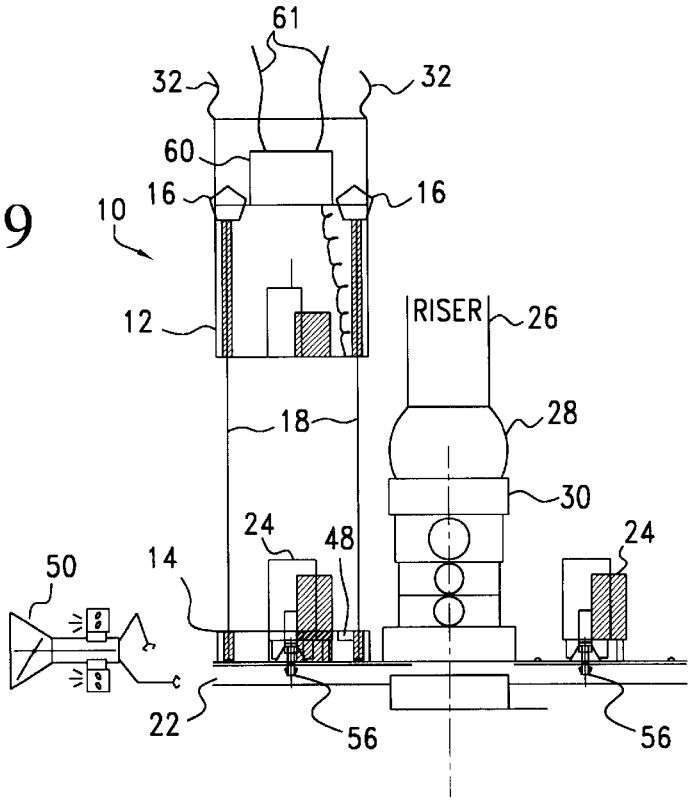
Figure 10A:
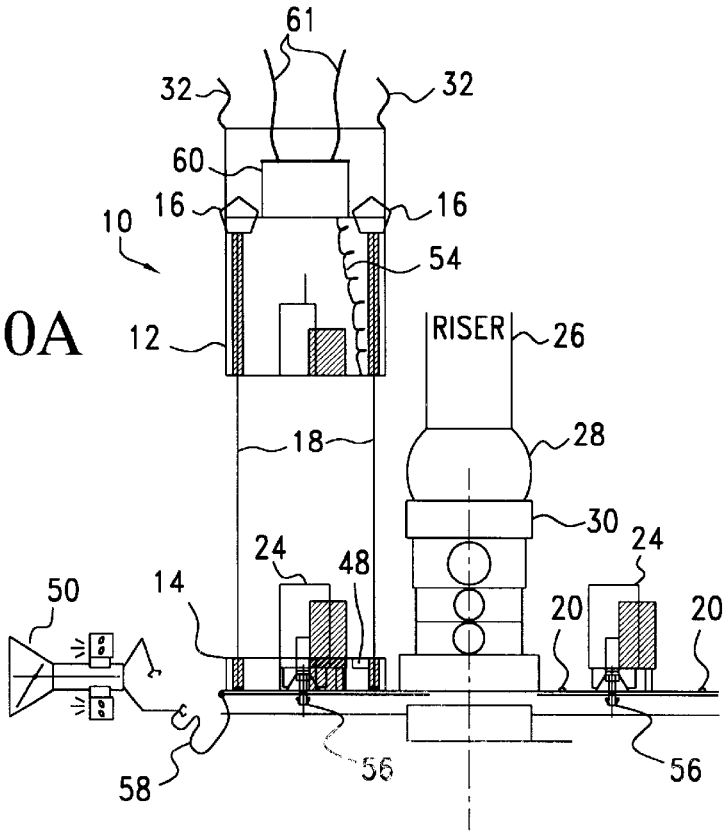
Figure 10B:
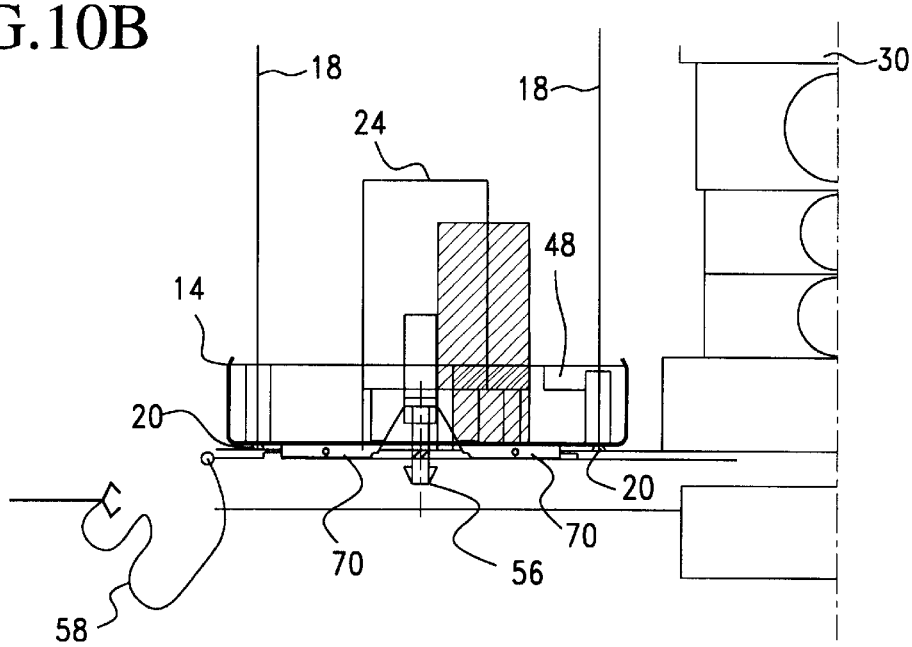
Figure 11:
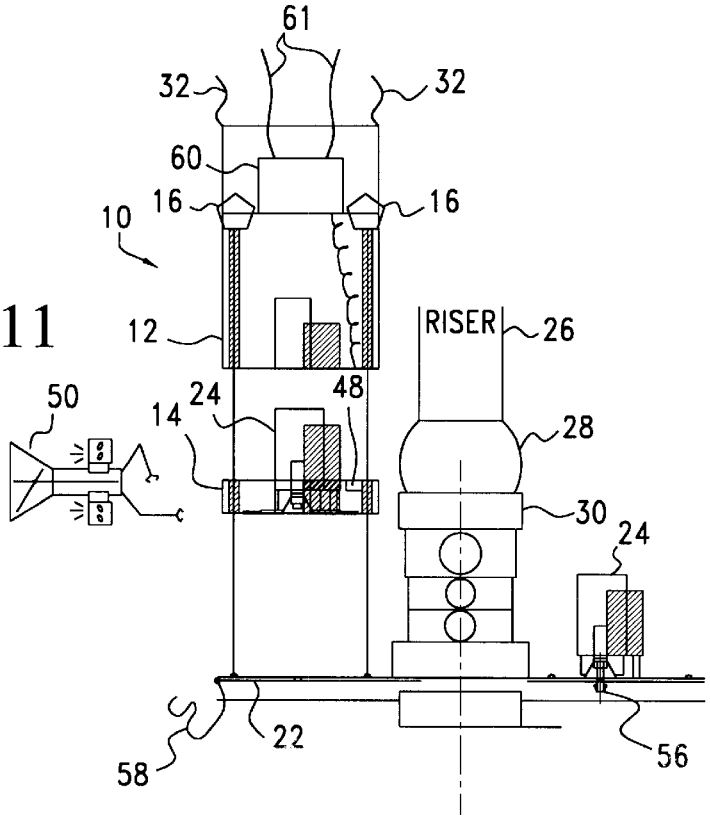
Figure 12:
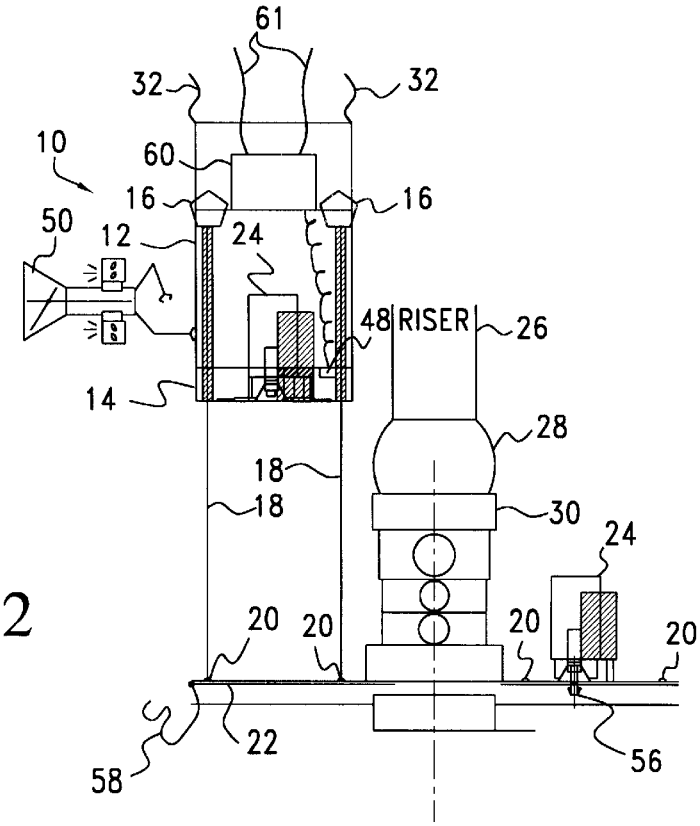
Figure 13:
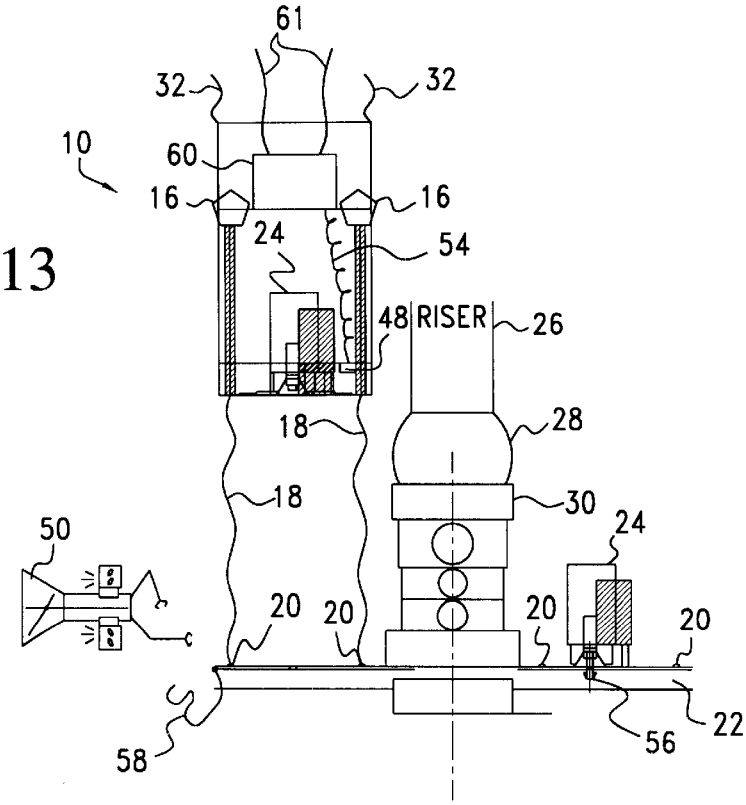
Figure 14:
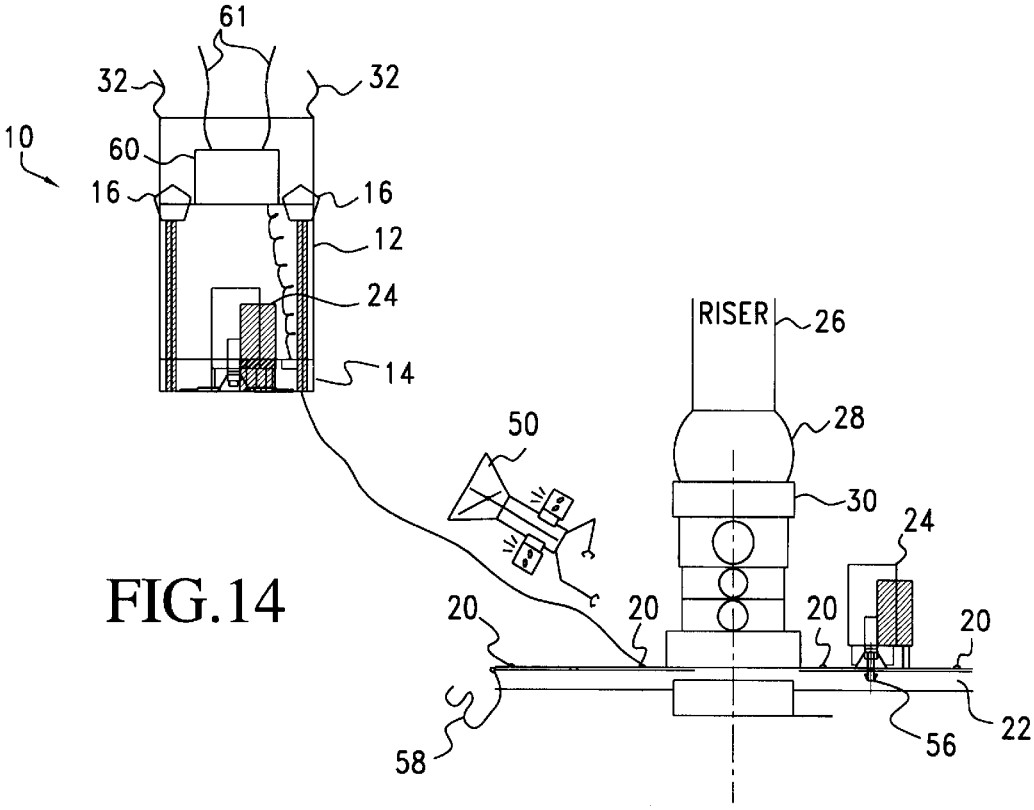

As shown in FIG. 8 the pod holder 14 has been released from the retrieval module 12 and is descending toward the pod 24 to be retrieved. In FIG. 9, the pod holder 14 rests on the platform 22 around the pod 24 and the ROV 50 has been moved to access a latching mechanism on the pod holder 14 using, e.g. an hydraulic flying lead lines (e.g. like the line 58, FIG. 10B) connected to appropriate valve ports (e.g. as for the mechanism 70, FIG. 10B). As shown in FIGS. 10A and 10B, the ROV is connecting an hydraulic line 58 (e.g. an hydraulic line connected to a source of hydraulic fluid under pressure on the platform 22 or extending from a surface fluid pressure source) to a pod holder latch mechanism 70 (see FIG. 10B) for latching onto the pod 24. The latch mechanism releasably holds the pod holder 14 on the pod 24. The ROV 50 also releases the latch mechanism 56 that holds the pod 24 to the platform 22. As shown in FIG. 11, the pod holder 14 with the pod 24 ascends toward the module 12 after the pod holder 14 is ballasted upwardly with the ballast mechanism 48. As shown in FIG. 12, the ROV connects the pod holder 14 to the module 12, e.g. using an MRL or other releasable connector. The module 12 is ballasted downwardly releasing tension on the lines 18 (FIG. 13) and the ROV then releases the lines 18 from the eyes 20 (FIG. 14). The winches 16 retrieve the lines 18 and the lines 32 are then used to raise the system 10 with the pod 24 to the surface. Instead of or in addition to the lines 32 additional lines connected to the system 10, e.g. lines 64 (FIG. 15) may be used for system retrieval and/or to keep the system 10 from contacting the riser 26. Thrusters and/or water jets may be added to the module 12 and dynamic positioning systems may then be used to insure that the module is correctly positioned relative to the riser. The ROV typically has cameras and can be used to back up the positioning system. Acoustics, DGPS, or other suitable media may be used.

Multiply Redundant Systems

Figure 16A:
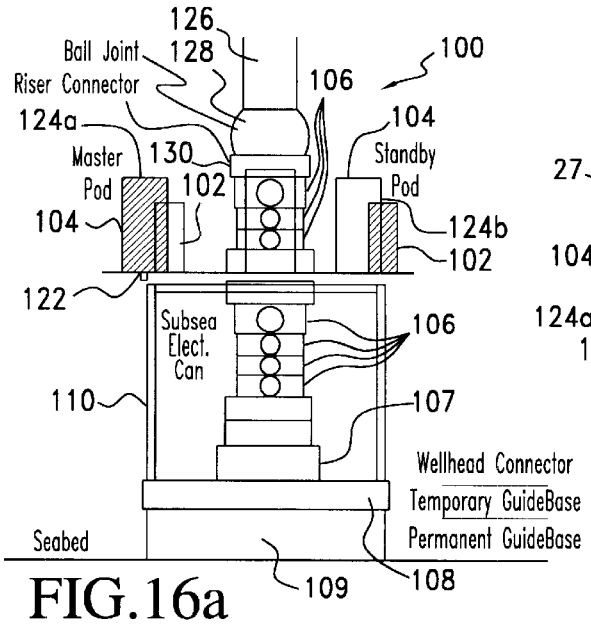
FIG. 16A is a schematic side view of a multi-pod system according to the present invention.
Figure 16B:
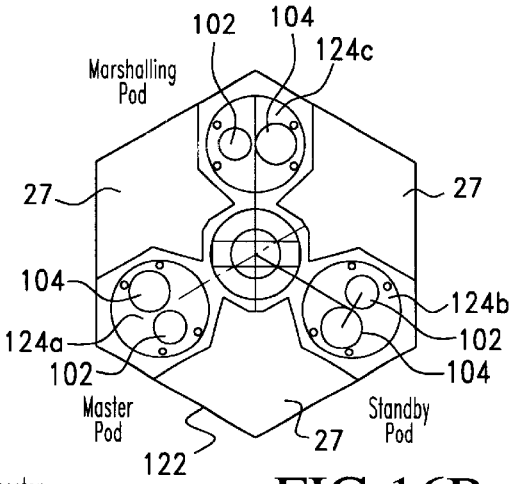
FIG. 16B is a top view of the system of FIG. 16A.
Figure 16C:
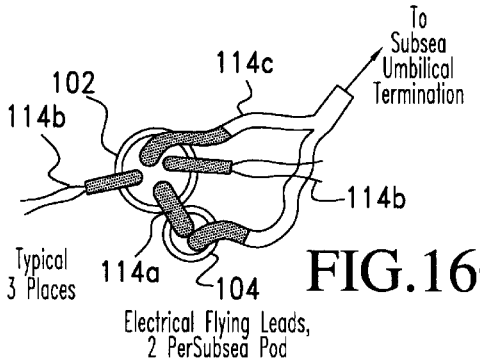
FIG. 16C is a top view showing external connections for a pod as in FIG. 16B (also shown schematically in FIG. 17C).
Figure 16D:
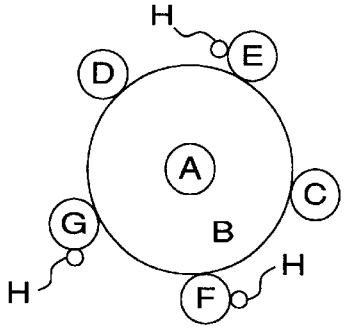
FIG. 16D is a cross-sectional schematic view of a typical marine riser and associated lines.

FIGS. 16A–16C illustrate a multiple (more than two) pod system 100 which provides multiple pod redundancy. A riser 126 extends from the water's surface (e.g. from a boat, barge or rig) to a ball joint 128 above a riser connector 130 on a platform 122 which contains POB'S. FIG. 16D shows a marine riser B with: a drill pipe string A therein; three electrical umbilical H, each associated with an hydraulic conduit E, F, or G; a kill line C; and a choke line D.

The system 100 has three similar pods 124*a*, 124*b*, and 124*c* spaced apart on an LMRP platform 122. Each pod has a valve can 104 and an electronics can 102, but it is within the scope of this invention for these components to be in one can or in more than two cans. The stack 110 (FIG. 16A) includes blowout preventers 106 and a wellhead connector 107 connected to a temporary guide base 108, and a permanent guide base 109 on the seabed. Preferably electrical flying leads 114*a*, 114*b*, and 114*c* are used to interconnect lines and umbilical to the valve cans and the electronics cans, as shown in FIG. 16C.

Figure 17:
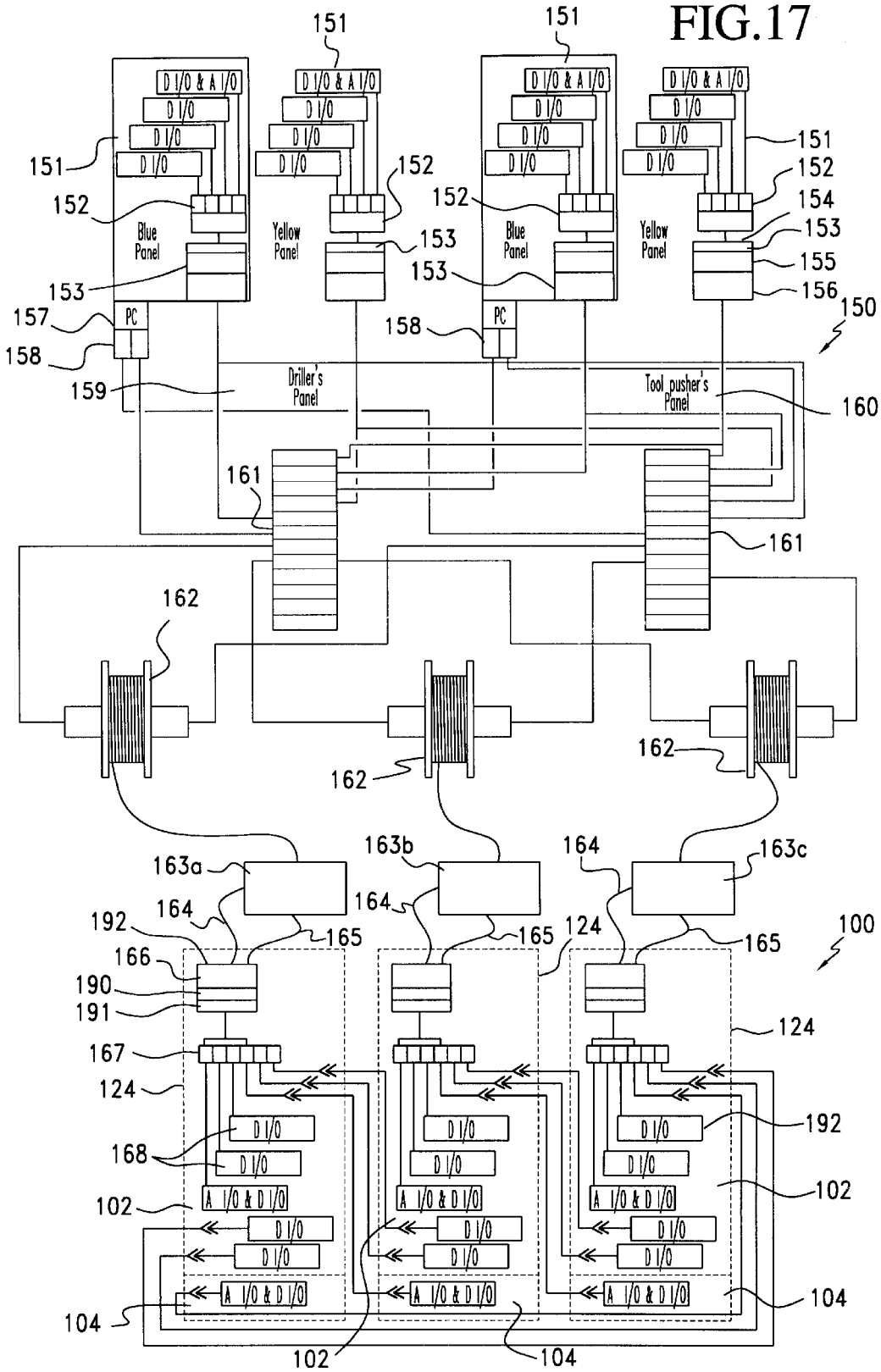
FIG. 17 is a schematic view of the system as in FIG. 16A.
Figure 17A:
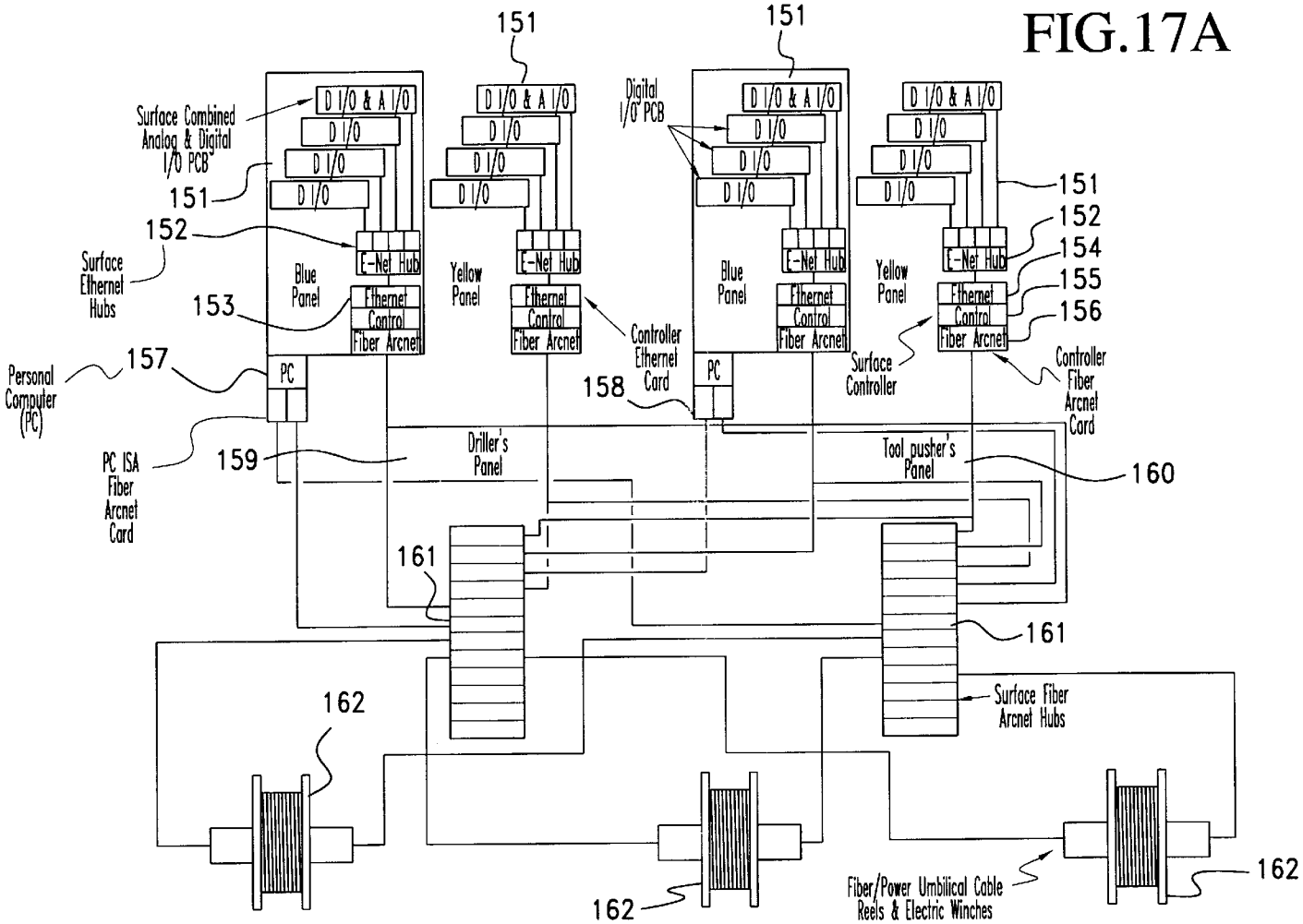
FIGS. 17A and 17B are enlargements of portions of FIG. 17.
Figure 17B:
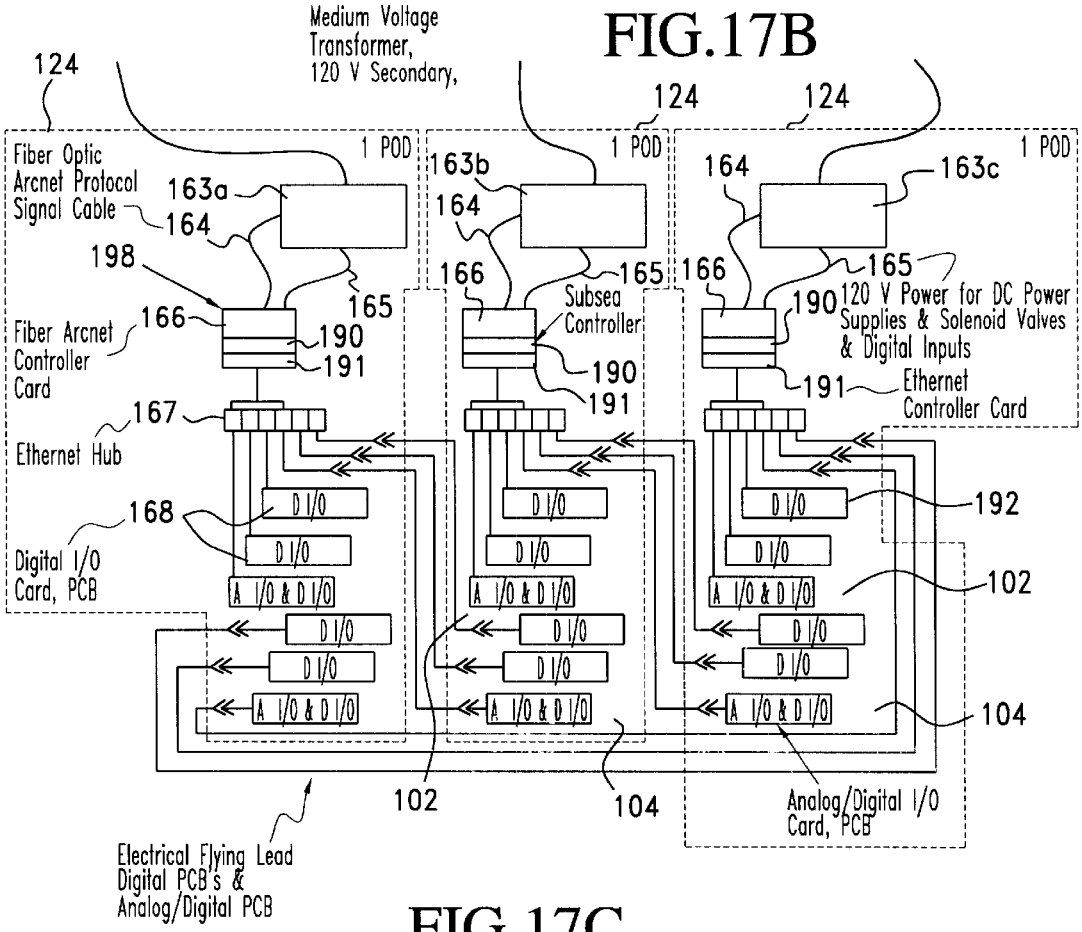

FIGS. 17 and 17A and 17B illustrate an embodiment of a multiply redundant system 150 using a system like the system 100 (FIG. 16A) and various other apparatuses and devices used, according to the present invention, with a system like the system 100. The system 150 (with a system 100) includes these components:

151 Surface Combined Analog/Digital Input/Output Computer Boards

152 Surface ETHERNET (tardemark) communication system Hubs

153 Surface Controllers with ETHERNET (tardemark) communication system Card (154), Controllers (155) and Fiber ARCNET (trademark) communication system Cards (156)

157 Computers [optionally with PC ISA Fiber Archnet Card (158)]

159 Driller's Panel

160 Tool Pusher's Panel

161 Surface Fiber ARCNET (trademark) communication system Hubs

162 Winches with fiber optic, power cables, umbilical cables, and associated hydraulic lines

163*a*, 163*b*, 163*c* Transformers

164 Fiber Optic ARCNET (trademark) communication system Protocol Signal Cable

165 Power line for DC Power Supplies & Solenoid Valves, and Digital Inputs

124 Pods (in dotted lines) with Fiber ARCNET (trademark) communication system Controller Cards (166); ETHERNET (tardemark) communication system Hubs (167); Digital Input/Output Cards (168)

Figure 17C:
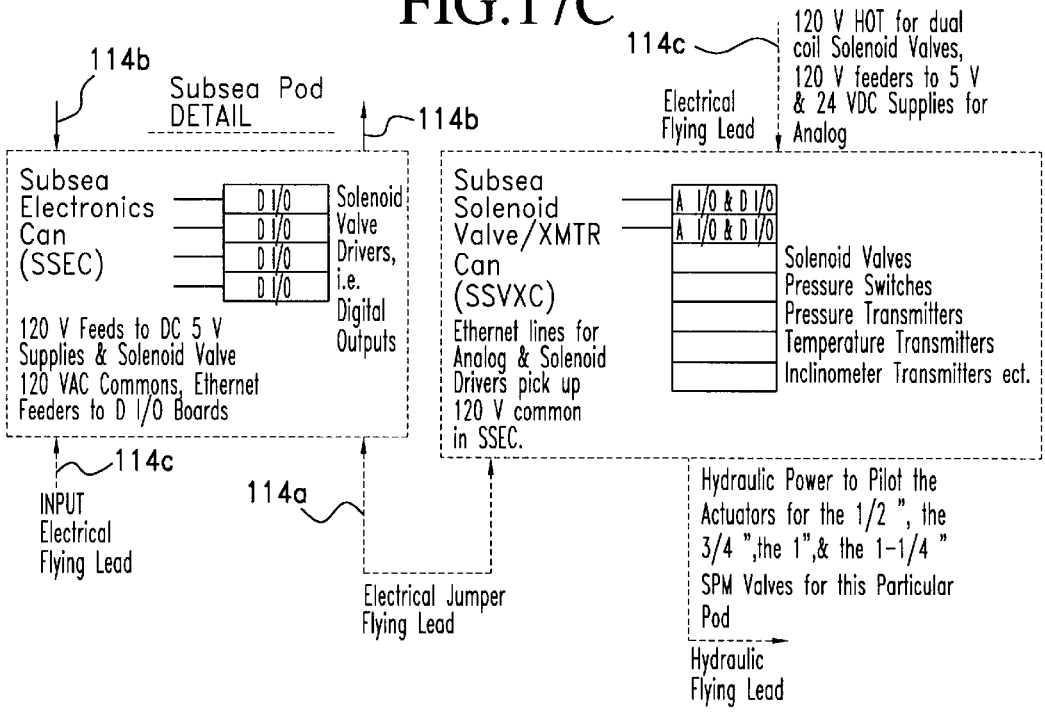
FIG. 17C shows schematically details of a pod and connections for a pod.

FIGS. 17A and 17B show schematically the system 150 in detail and, in FIG. 17C, schematic detail for a pod 124.

Although it is new and nonobvious to provide a multiply redundant system as shown, e.g., in FIG. 17, the various components shown are all old and well known and are of the type used in the one pod or two pod prior art systems.

Figure 19:
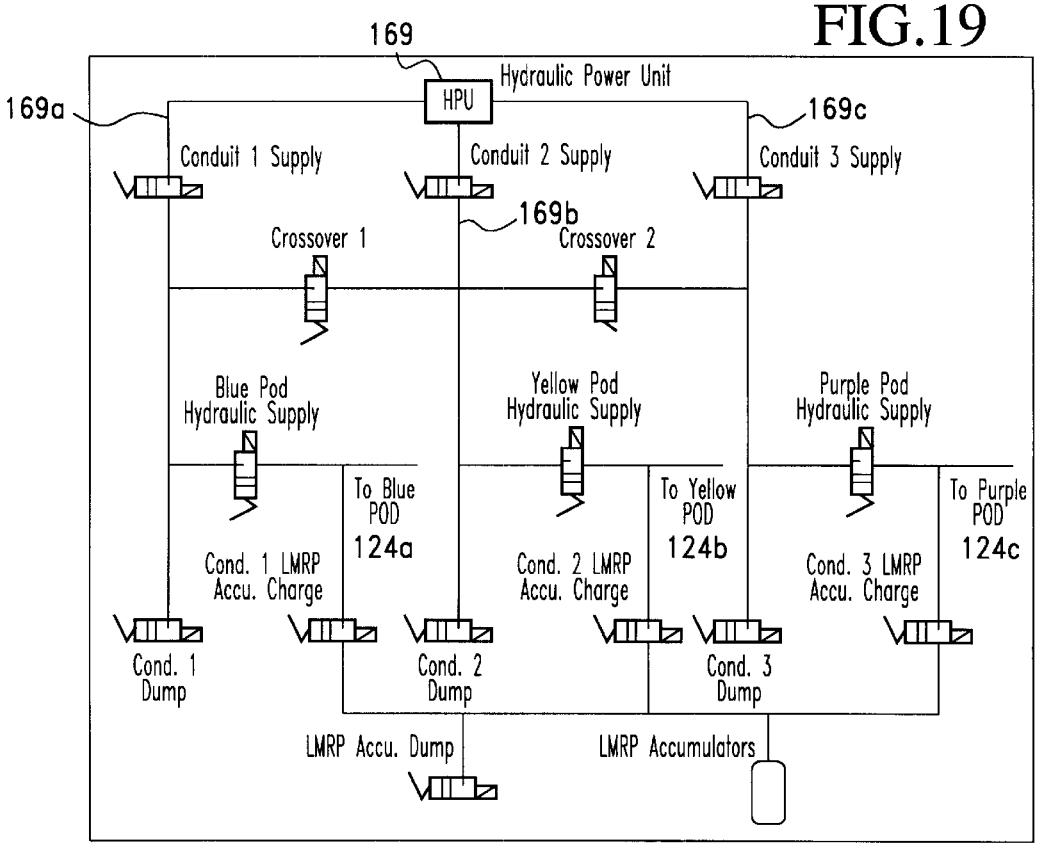

As shown in FIG. 19, an hydraulic power unit 169 has three conduits 169*a*, 169*b*, and 169*c*, one each for each of the pods 124*a*, 124*b* and 124*c*. Fluid is supplied by conduit 1 ("Cond. 1"), conduit 2 ("Cond. 2") or conduit 3 ("Cond. 3"). Labels in FIG. 19 are as follows:

Cond. 1 Dump: solenoid valve (SV) dumps the conduit 1 fluid, e.g. to the sea Cond. 1 LMRP Accu. Charge: SV charges the accumulator from conduit 1

Cond. 2 Dump: SV dumps fluid in conduit 2

Cond. 2 LMRP Accu. Charge SV: Charges the accumulator from conduit 2

Cond. 3 Dump: SV dumps fluid in conduit 3

Cond 3 LMRP Accu. Charge: Charges the accumulator from conduit 3

Figure 18:
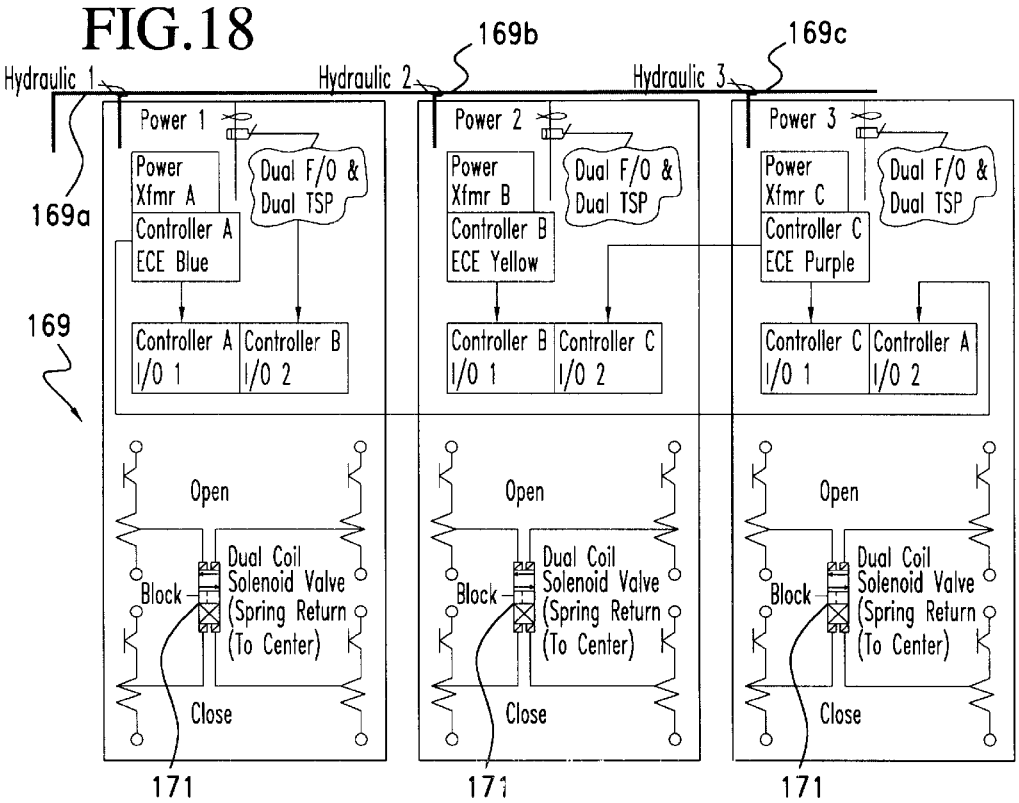
FIGS. 18 and 19 are schematic views of the circuits of the system of FIG. 16A, FIG. 18 showing electrical circuits and hydraulic circuit interfaces and FIG. 19 showing hydraulic circuits for three conduits.

LMRP Accu. Dump: SV dumps the fluid in the accumulator and in an associated manifold LMRP Accumulators: hold fluid for @ conduit and are charged via any of the conduits The system 150 with a system 100 is "triple redundant" with respect to its subsea controllers 190 and its pods 124 (which are like the pods 124*a* and 124*b*, FIG. 16A). Each pod contains a "stand alone" controller 190 that controls and monitors analog and digital inputs and outputs within a native electronics control enclosure can 102 and a valve can 104. The controller 190 is contained in a can 102. Via appropriate electrical flying leads, each controller 190 also controls input and output for one other pod; thus each pod has its own interior controller activating the native associated I/O and also has I/O that can be controlled by another controller (in another pod) exterior to the pod and each separate pod (of the multiple pods) is, therefore, dually redundant. FIGS. 18 and 19 illustrate this system multiple redundancy. In FIG. 18, labels indicate:

Power 1: Power transformer 1, numeral 163*a* in FIG. 17.

Power 2: Power transformer 2, numeral 163*b* in FIG. 17.

Power 3: Power transformer 3, numeral 163*c* in FIG. 17.

Power Xfmr A: indicates a power transformer 1.

Controller A: in ECE Blue: an I/O controller in pod 124*a* fed from Power 1 ("ECE" means an electronics control enclosure, e.g. like the can 102) for a Blue pod.

Controller B: an I/O controller in pod 124*b* fed from Power 2

Controller B ECE Yellow: an I/O controller in a Yellow Pod like Controller A in the Blue pod.

Controller C ECE Purple: an I/O controller in a Purple Pod like Controller A in the Blue pod.

Each Controller A, B, C has associated with it two sets of I/O, e.g. in the Blue pod Controller A I/O 1 and Controller B I/O 2.

As shown in FIG. 18, each pod contains a solenoid valve 171 in one aspect a three position dual coil solenoid valve. The electronics within the pod control the flow of hydraulic fluid (e.g. in lines 169*a*, 169*b*, 169*c*) to the valves 171. These valves, in turn, provide fluid flow to other functions on the LMRP or to SPM valves to actuate direct fluid to valves and/or devices in the stack to perform various stack functions.

Figure 20:
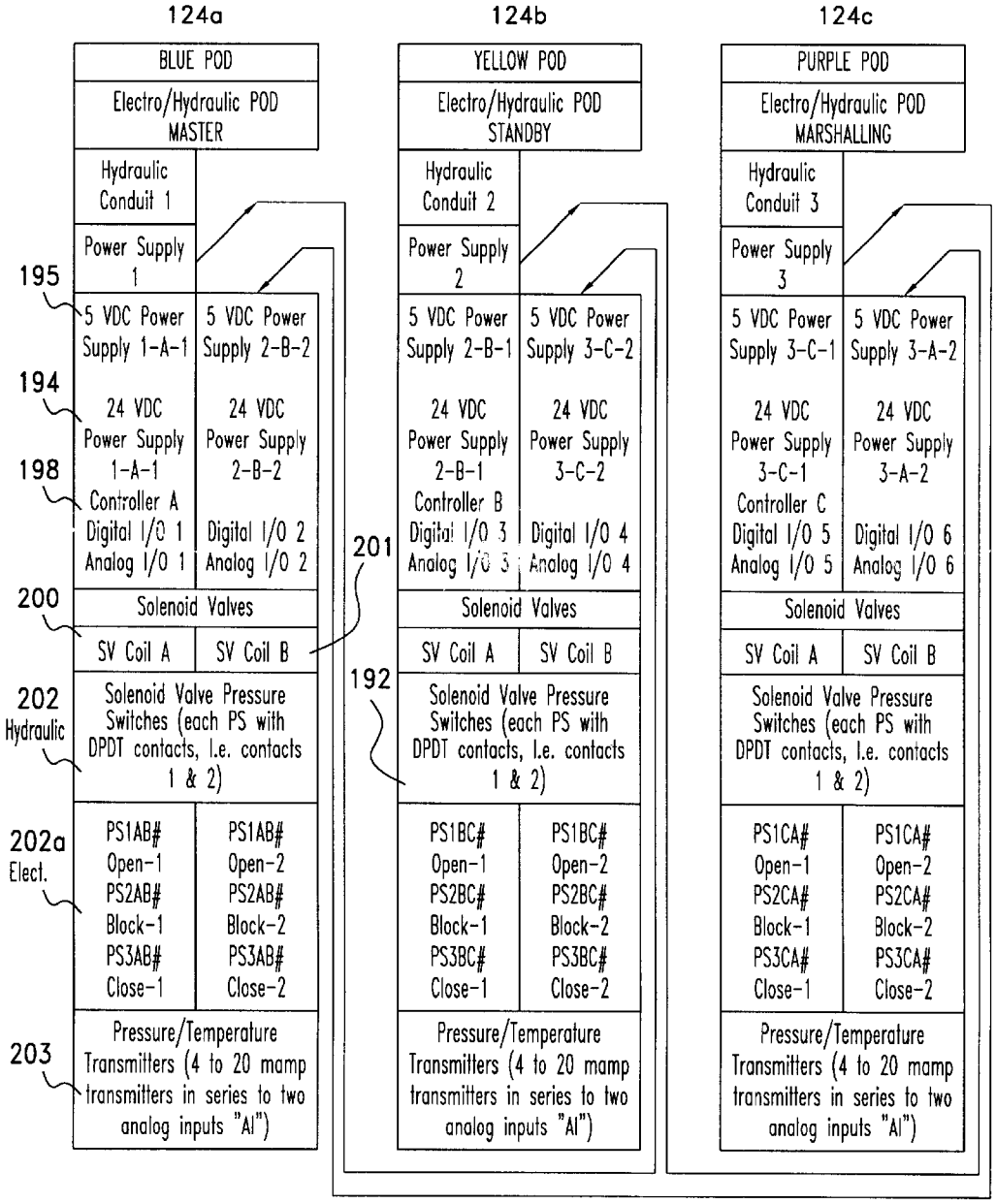
FIG. 20 is a chart showing the interconnection of the three pods of FIG. 16A.

For a system like the system 150 a Driller can select a variety of configurations for an active master pod, a standby pod, and a "marshalling" pod (as in FIG. 20):

| Configuration | Master | Standby | Marshall |
|---|---|---|---|
| 1 | 124a | 124b | 124c |
| 2 | 124b | 124c | 124a |
| 3 | 124c | 124a | 124b |

For Configuration 1, hydraulic power is provided via conduit 169*a* (FIG. 19) with none of the crossover valves activated; for Configuration 2, via conduit 169*b*; and for Configuration 3, via conduit 169*c*. Such configuration selections may be made by the Driller (using the Driller's Panel 159 FIG. 17) or by the Toolpusher using the Toolpusher's Panel 160 (FIG. 17).

The marshalling pod monitors the master pod and the standby pod. All three pods receive commands from the surface (top FIG. 17). Initially, in one aspect, the hydraulic supply is directed to the master pod 124*a* via the conduit 169*a* (or with appropriate valve open, via the other conduits). The controller of the standby pod 124*b* also provides input and output to the I/O of the master pod 124*a*.

When the controller in the master pod 124*a* and the controller in the standby pod 124*b* receive a command from the surface, e.g. to perform a stack function, each of these controllers echoes the command. For a command to be actuated, a function is first "Armed," then the command is echoed back by each controller, the echoes are compared with the command by the marshal pod 124*c*. If they agree, the marshalling pod tells the master pod to execute the command, then the master pod 124*a* issues a signal to perform the commanded function. The standby pod 124*b* also issues the signal to perform the commanded function at a predetermined later time, e.g. one hundred milliseconds. The marshalling pod 124*c* receives signals from each of the other pods indicating that each of them issued a signal to perform the commanded function (and that the appropriate valves were activated to do so by pressure switch feedbacks) (and that the system did indeed then perform the commanded function by monitoring hydraulic flow meters in the active hydraulic conduit). If the signals regarding performance of the function agree, the function response from the Master Controller 124*a* is time-stamped and logged into the Master Controller's Memory and entered into the data logging PC (typically the Driller's PC) when polled by the PC. Similarly the standby controller writes its data to memory. If the feedback signals regarding performance of the function are not in agreement, the marshalling pod 124*c* compares the response from the other pods (124*a* to 124*c*; 124*b* to 124*c*). If the two pods 124*a* and 124*c* compare and agree (feedbacks agree with commands) then the standby pod 124*b* is "flagged" (e.g. at the Driller and Toolpusher panels and/or with alarms) as not comparing and agreeing. At this point the standby pod 124*b* can be placed out of service or this can be done when a certain number of not agreeing signals are associated with the standby pod, e.g. two, three, four or more. Similarly, if the marshalling pod 124*c* does not agree with the master pod, then a comparison is run by the marshalling pod 124*c* between the standby pod 124*b* and the marshalling pod 124*c*. If the marshalling pod 124*c* and the standby pod 124*b* compare and agree, then only the standby pod controller has performed the commanded function in the master pod I/O. The standby pod's controller has fired the standby input/output in the master pod 124*a* using the hydraulic supply conduit 169*a* of the master pod 124*a*. If the marshalling pod 124*c* and the standby pod 124*b* disagree (once, twice, thrice, or more i.e. a predetermined number) the Driller (who is alerted to this on his panel 159) can decide which hydraulic supply to use (e.g. using values, etc. as in FIG. 19) and which set of input/output devices (e.g. Configuration 1, 2, or 3) to perform a desired function.

In certain situations, if the Driller places one of the pods out of service, hydraulic supply for the in-service pods may be supplied by the conduits for these pods (rather than the conduit to the out of service pod). Other pods can be designated as master and standby. Optionally, the functions of a marshalling pod can be assigned to a surface unit, e.g. but not limited to, a unit not being used as a command center (e.g. the Toolpusher's computer controller). Alarms communicate that multiple redundancy has been lost subsea when a pod goes out of service. Alarms may be used on one, some, or all panels, MMI's, and data loggers. Any suitable alarms may be used, including, but not limited to lights, horns, print outs buzzers, etc. Alarms may be activated by a marshalling pod, ARCNET (trademark) communication system communications, ETHERNET (trademark) communication system Communications, or by any controller.

Figure 25A:
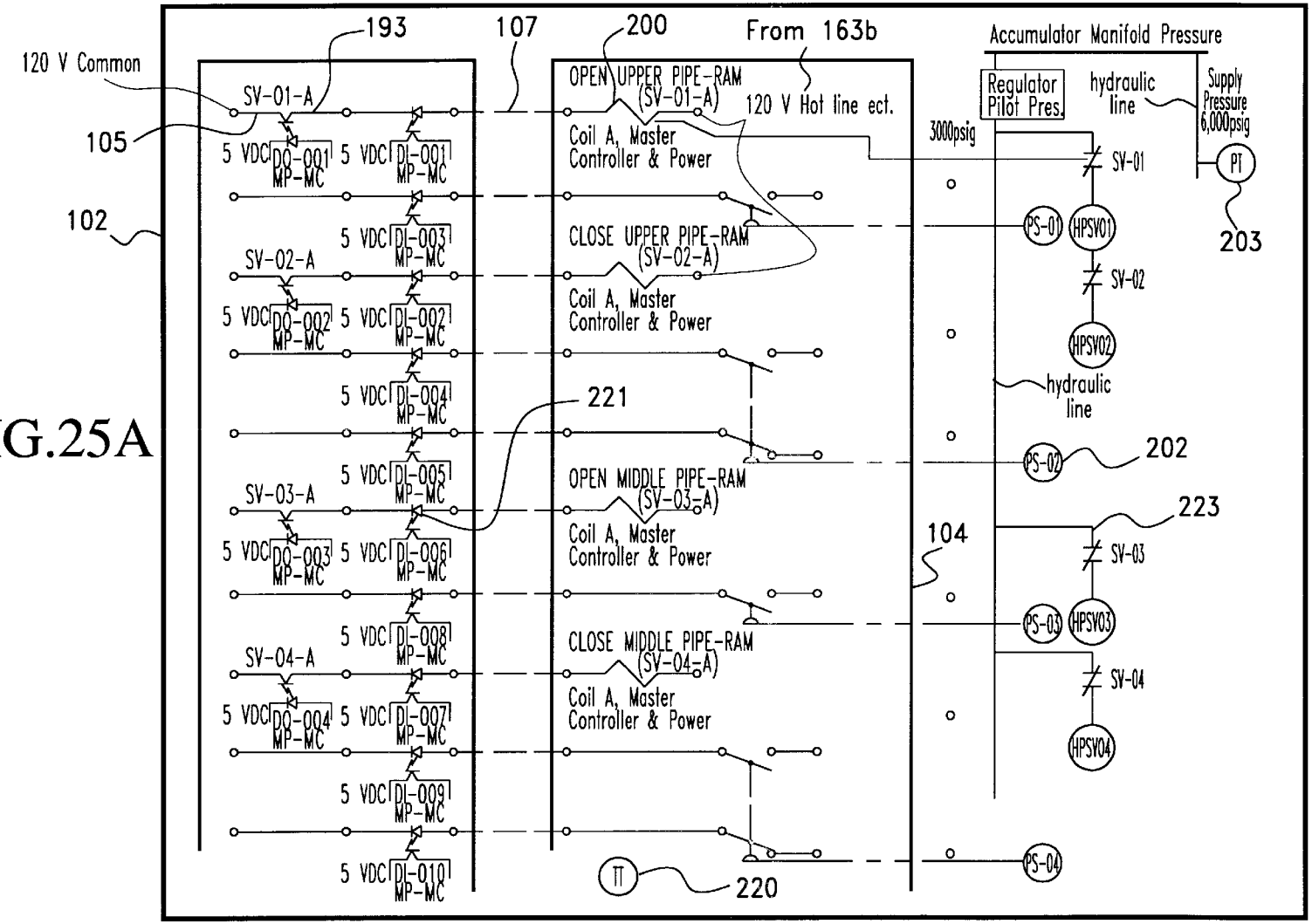
FIGS. 25A–25C show details ("DETAIL" in FIG. 24) of the electronics of FIG. 24.
Figure 25B:
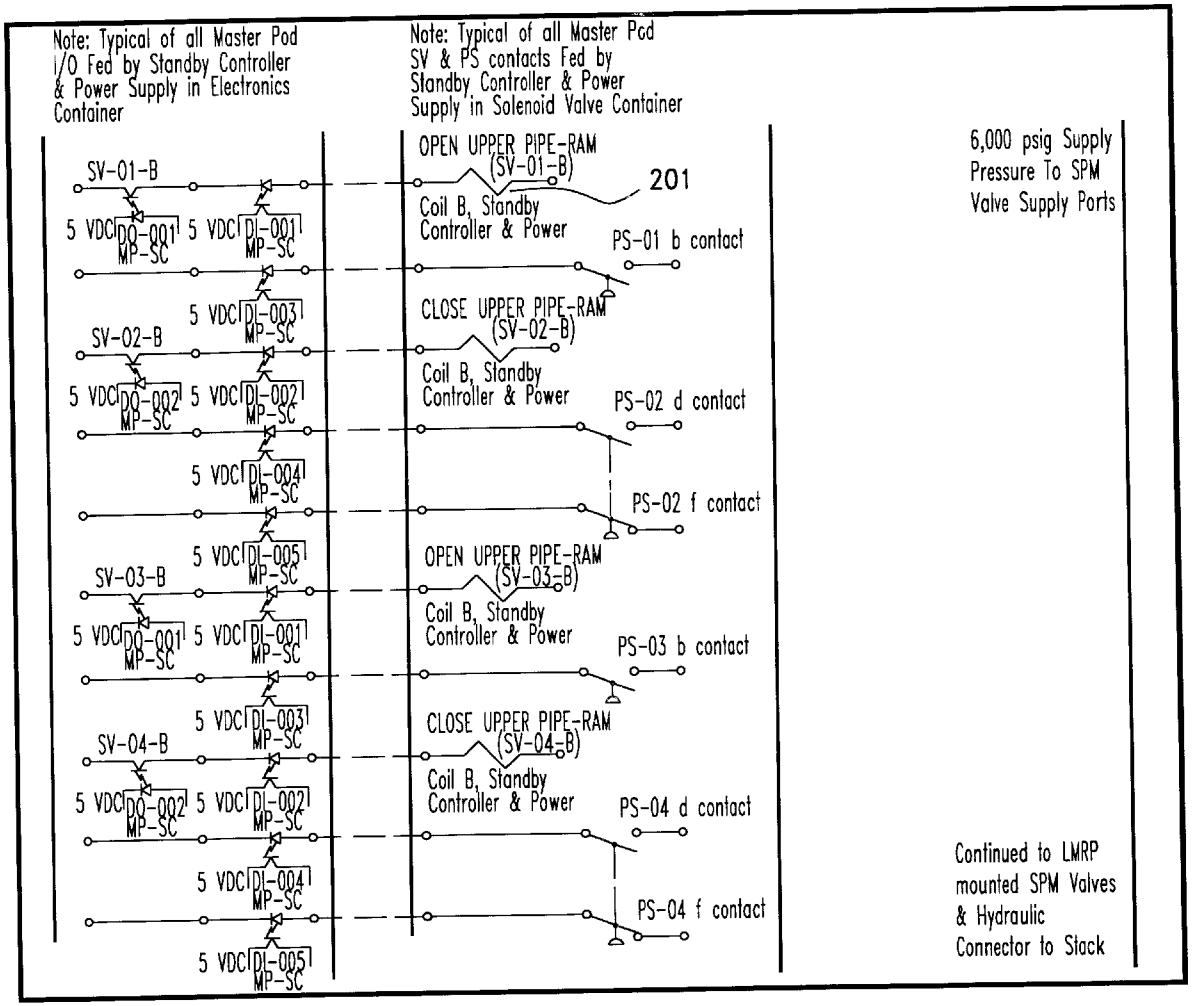
Figure 25C:
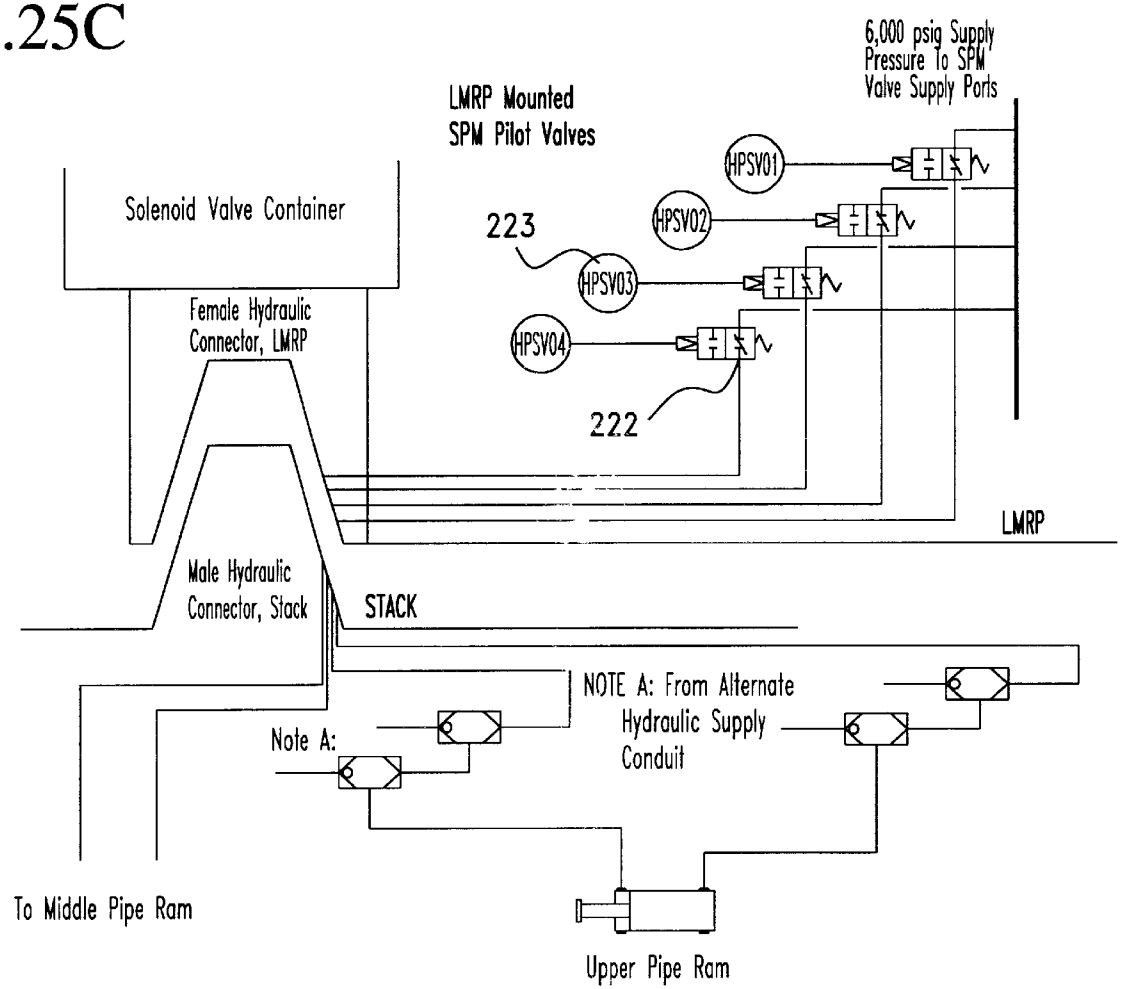

During normal triple redundant operation, all three pods are electrically actuated with each command. The marshalling pod 124*c* also fires its solenoids in its valve can 104 and in the redundant input/output in the pod 124*b*. The standby pod's (124*b*) main input/output in its container is also fired electronically in pod 124*b*'s container. This insures that all three sets of redundant input/output and the associated solenoids are fired from both coils. Read-back is also received from pressure switches 202 (FIG. 25A) in pod 124*a* and from all in-line inputs 221 (FIG. 25A) to each output. This insures that all solenoid valves are functioning under normal operations if and when a reconfiguration is activated. Only one pod will be active hydraulically. Thus the only thing that is not in "Hot Standby" are the hydraulic pilot power through the solenoids piloting the SPM valve actuators and the hydraulic supply power to and from the SPM valves supply ports 222 (FIG. 25C). The Driller alone controls the assignment of a hydraulic conduit to each pod. Once the triple redundancy is lost, a decision is made whether or not to pull and replace the out-of-service pod. It should be remembered that, in this condition, dual redundancy is the status of each remaining pod and also in the BOP subsea Control System itself. "Read back" is a digital input indicating a pressure switch has closed in a pilot line 223 (FIGS. 25A and 25C) to an SPM valve. This gives an "Inferred" position indicative that the SPM valve actuator has been energized or an SV was fired. "Hot Standby is when a pod is electronically active but without hydraulic power supplied to it.

Figure 23A:
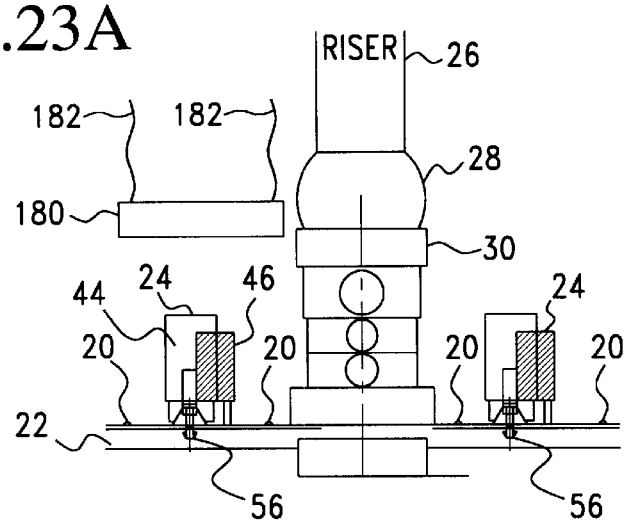
FIG. 23A is a schematic view of a system and method according to the present invention.
Figure 23B:
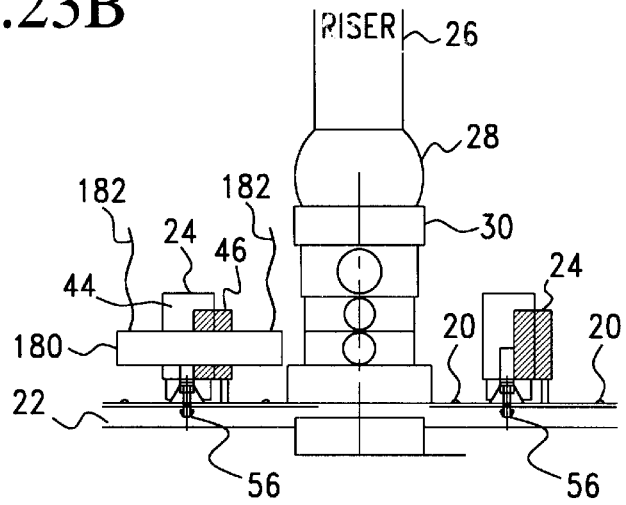
FIG. 23B shows a step in the method of FIG. 23A.
Figure 23C:
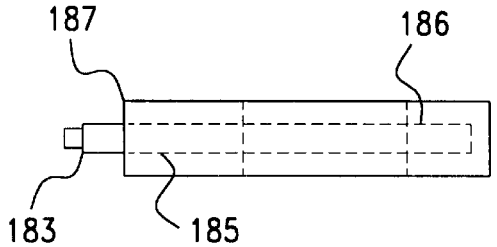
FIG. 23C is a side view of a pod holder according to the present invention.

FIGS. 23A and 23B show a buoyant pod holder 180 positioned above a pod 24 (items like those in FIG. 5 bear the same numerals). The pod holder may be moved into position by a diver, by an ROV, and/or lowered on optional lines 182. As shown in FIG. 23B the pod holder 180 is secured in place around a pod 24. Any suitable releasable securement apparatus or device may be used, including but not limited to: Velcro™ material; latch mechanisms; screens; bolts; glue; releasable bayonet mount apparatus. The latch 56 is released (e.g. by a diver, by an ROV, by an hydraulic actuator or by remote control) and the pod 24 is freed for raising to the surface. FIG. 23C shows an alternative embodiment of a pod holder for use in pod retrieval systems and methods according to the present invention. A pod holder 187 has a quick disconnect pneumatic connector 183 connected by tubing 185 into the ballast chamber 186 or inflatable bladder of the pod holder. The chamber is filled with gas (e.g. air, nitrogen) and/or inflated by applying gas under pressure through the connector 183. Any suitable expandable air holding apparatus may be used for the bladder. Inflating the bladder releasably secures the pod holder 187 around a pod to be retrieved.

Figure 21A:
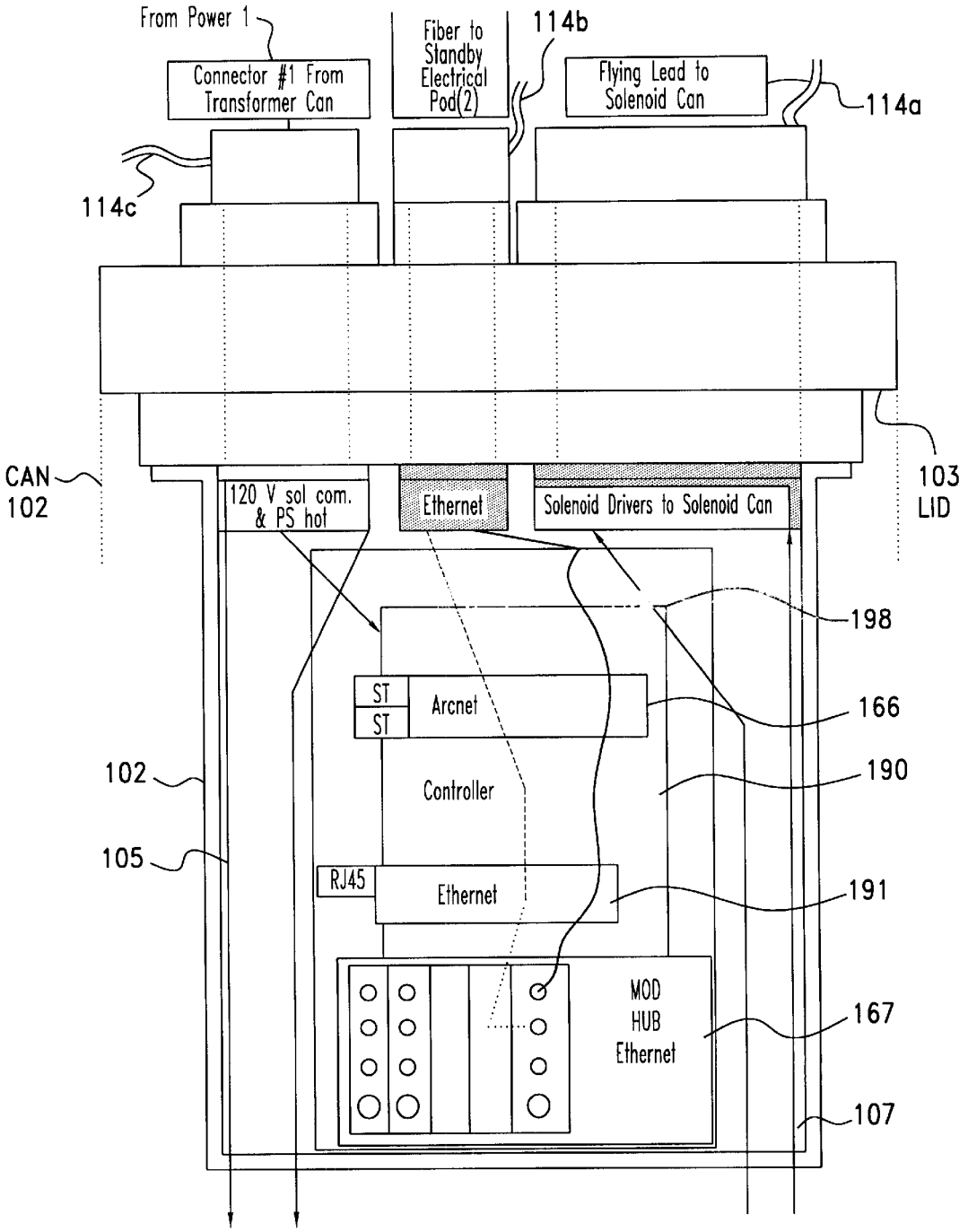
FIG. 21A shows schematically a pod's lid or cover for an electronics can.

FIG. 21A shows schematically a top or lid of an electronics can 102 (also like the cans 46) of the system 100. The flying leads 114*a*, 114*b*, and 114*c* as shown in FIG. 16C are also shown in FIG. 21A. A lip 103 seats on the can 102 which sits on the LMRP platform.

The lines 105 (two shown; in one aspect there are 48 such lines) are lines interconnecting the can 46's electronics to its corresponding valve can 104 (these are lines 114*c* in FIG. 16C). The function of the lines 105 is to complete the solenoid circuit with the 120 volt neutral. The 120 volt neutral line 105 in FIG. 25A is ground for the digital outputs for the solenoid drivers 193 (FIG. 25A).

The lines 107 indicate conductors (two shown; in one aspect there are 48 such lines for each board circuits (for two boards—96 lines) that interconnect the solenoid drivers 193 in the electronics can 102 to solenoid valves in the corresponding valve can 104. The lines 107 connect the solenoid drivers to the solenoids.

"120 V Sol com. & PS hot" refers to the 120 VAC common. The 5V and 24 VDC power supplies 194 and 195, 196 are on the controller chassis 198.

"Fiber to Standby electrical pod (2) refers to a fiber optic cable between the master pod and the standby pod.

FIG. 21B shows schematically a digital input/output apparatus or board 192/168 (see FIG. 17) in the electronics can 102. There are two 64 channel boards in the can 102. In Summary, for a D I/O as in FIG. 21B digital outputs (DO) are equal to solenoid drivers and digital input (IO) equals to DI-01, DI-02, DI-03, etc. (see FIGS. 25A–25C). The "5 VDC Power" is fed by 120 VAC and the output is 5VDC.

Figure 24:
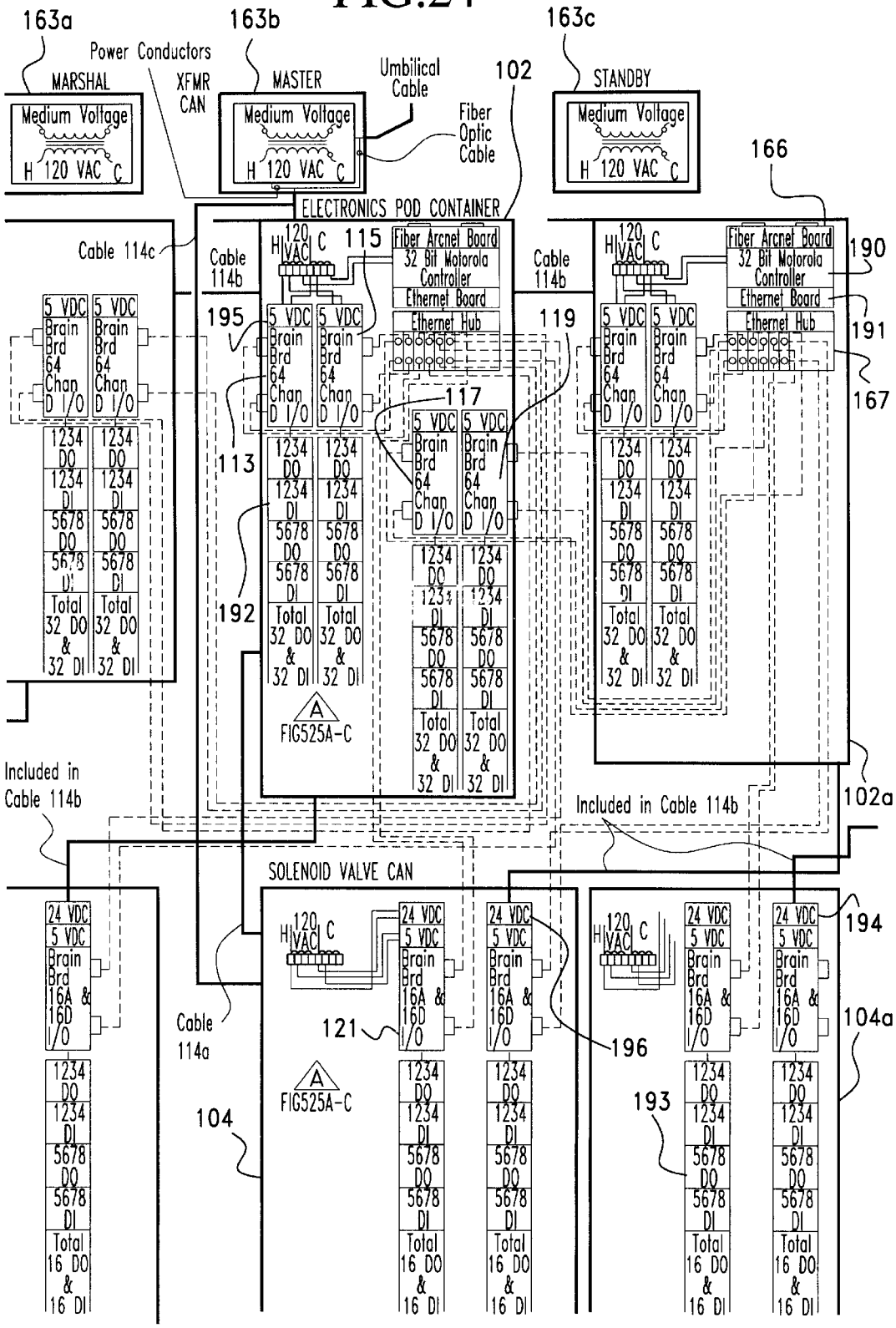
FIG. 24 is a schematic view of various pod container electronics.

FIG. 21C shows various interconnections for a controller as shown in FIGS. 17 and 21A. The "top hat connector" is the top portion of the can 102 as shown in FIG. 21A. The "Fibers to Connector in Top-Hat" 109 provide communications from the surface controllers to the subsea controllers. "Pins" in the top-hat connector are internal wiring in electrical connectors. In one aspect the controller 190 ("Modular Controller") is a 32-bit 4 MB Motorola Microprocessor with battery backup and 2 MB Flash EEPROM. The "Standby Electrical Pod" is pod 102*a* in FIG. 24. The "Standby Solenoid Valve Can" is the valve can for the standby pod 104*a*, FIG. 24. Brain boards (software to hardware interfaces) include: Brain Board E 113; Brain Board F 115; Brain Board G 117; Brain Board H 119; Brain Board D 121 (FIGS. 21 and 22).

Figure 22:
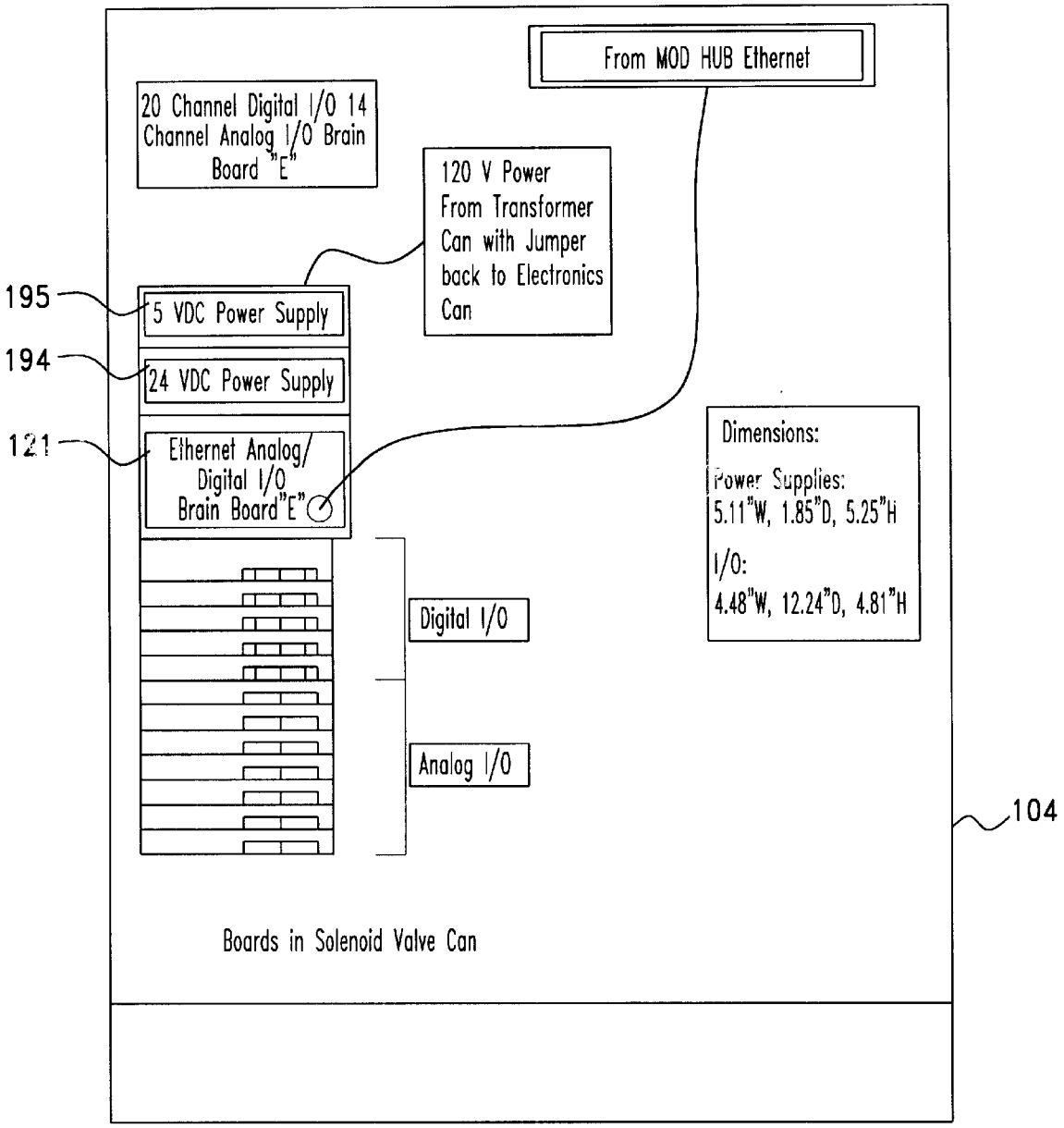
FIG. 22 shows schematically electronics associated with a master pod's solenoid valve can.

FIG. 22 shows schematically various printed circuit boards ("boards" for the I/O modules) in a valve can 104 of the system 100. Electronics in this can 104 are interconnected via lines 114*a* (FIG. 24) with electronics in the corresponding electronics can 102. Also present, though not shown in FIG. 22, in the can 104 are the solenoid valves 200 and 201, pressure transmitters 203, and temperature transmitters 220 (see FIGS. 25A–25C).

The present invention in certain, but not necessarily all, embodiments discloses a method for retrieving a subsea pod container from a subsea lower marine riser platform to which the subsea pod container is releasably connected, the lower marine riser platform releasably connected to a subsea stack and located beneath a surface of water, the method including positioning a buoyant pod holder above the subsea pod container, releasably connecting the buoyant pod holder to the subsea pod container, releasing the subsea pod container from the subsea lower marine riser platform, and raising the buoyant pod holder with the subsea pod container to a location at the surface. Such a method may be used when the lower marine riser platform is associated with a riser used for subsea drilling operations and the subsea pod container is retrieved without interrupting the drilling operations; and/or wherein the subsea pod container is retrieved without disconnecting the lower marine riser platform from the subsea stack.

The present invention in certain, but not necessarily all, embodiments discloses a method for retrieving a subsea pod container from a subsea lower marine riser platform to which the subsea pod container is releasably connected, the lower marine riser platform releasably connected to a subsea stack and located beneath a surface of water, the method including positioning a pod holder above the pod container, the pod holder having a selective ballasting apparatus, lowering the pod holder to the subsea pod container and releasably connecting the pod holder to the subsea pod container, rendering the pod holder buoyant by activating the selective ballasting apparatus, raising the pod holder with the subsea pod container to the retrieval module, and raising the pod holder with the subsea pod container to a location at the surface. Such a method may be used when the lower marine riser platform is associated with a riser used for subsea drilling operations and the subsea pod container is retrieved without interrupting the drilling operations; and/or wherein the subsea pod container is retrieved without disconnecting the lower marine riser platform from the subsea stack. Any such method may include latching the pod holder to the retrieval module prior to raising the pod holder with the subsea pod container.

The present invention in certain, but not necessarily all, embodiments discloses a method for retrieving a pod container from a subsea lower marine riser platform to which the pod container is releasably connected, the lower marine riser platform releasably connected to a subsea stack and located beneath a surface of water, the method including positioning a retrieval module above the pod container, the retrieval module having a pod holder releasably connected thereto disconnecting the pod holder from the retrieval module, lowering the pod holder to the pod container and releasably connecting the pod holder to the pod container, releasing the pod container from the subsea lower marine riser platform, raising the pod holder to the retrieval module and releasably connecting the pod holder with the pod container to the retrieval module, and raising the retrieval module with the pod container to a location at the surface. Such a method may include one, some, or all of the following in any possible combinations: wherein the lower marine riser platform is associated with a riser used for subsea drilling operations and the subsea pod container is retrieved without interrupting the drilling operations; wherein the subsea pod container is retrieved without disconnecting the lower marine riser platform from the subsea stack; releasably connecting the retrieval module to the lower marine riser platform prior to releasably connecting the pod holder to the pod container; wherein an ROV releasably connects the retrieval module to the lower marine riser platform; wherein the pod holder has a selective ballasting apparatus and the method including raising the pod holder by ballasting it upwardly using the selective ballasting apparatus; wherein the lower marine riser platform has a compressed air supply and air from said compressed air supply is used to ballast the pod holder upwardly; wherein an hydraulically activated latch mechanism releasably secures the pod container to the lower marine riser platform and the lower marine riser platform has a supply of hydraulic fluid under pressure, the method including activating the hydraulically activated latch mechanism with hydraulic fluid under pressure from the supply of hydraulic fluid; controlling position of the pod holder with at least one line; and/or latching the pod holder to the retrieval module prior to raising the pod holder with the subsea pod container.

The present invention provides in certain, but not necessarily all, embodiments, a multiply (triply, quadruply, quintuply, etc.) redundant control system for subsea drilling operations.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A control system for controlling drilling apparatus during subsea drilling operations during subsea retrieval of a subsea pod container containing apparatus for controlling the subsea drilling operations, the control system comprising a first subsea pod container containing apparatus for controlling the subsea drilling operations, a second subsea pod container containing apparatus for controlling the subsea drilling operations, a third subsea pod container containing apparatus for controlling the subsea drilling operations, activation apparatus for activating a chosen one of the subsea pod container's apparatus for controlling the subsea drilling operations and maintenance apparatus for maintaining the two subsea pod containers other than the chosen one in a standby mode so that triple redundancy of control of the subsea drilling operations is provided, selection apparatus for selecting one of the subsea pod containers other than the chosen one from the two subsea pod containers maintained in standby mode in the event of a failure of the apparatus in the chosen subsea pod container for controlling the subsea drilling, and standby pod activating apparatus for activating a subsea pod container which was initially in standby mode for controlling the subsea drilling operations, so that the subsea drilling operations are not interrupted during retrieval of the chosen pod whose apparatus for controlling the subsea drilling operations has failed.

2. The control system of claim 1 wherein the subsea pod containers are releasably connected to a subsea lower marine riser package, the lower marine riser package releasably connected to and above a subsea stack and located beneath a surface of water, the lower marine riser package on a lower marine riser platform.

3. The control system of claim 1 wherein the subsea pod containers are retrievable without disconnecting the lower marine riser platform from the subsea stack.

4. The control system of claim 1 wherein hydraulically activated latch mechanism releasably secures the subsea pod containers to the lower marine riser platform and the lower marine riser platform has supply of hydraulic fluid under pressure for activating the hydraulically activated latch mechanism with hydraulic fluid under pressure from the supply of hydraulic fluid.

* * * * *